US006464321B1

(12) United States Patent
Nunokawa

(10) Patent No.: US 6,464,321 B1
(45) Date of Patent: Oct. 15, 2002

(54) PRINTING APPARATUS HAVING FUNCTION OF ADJUSTING POSITIONAL MISALIGNMENT OF DOTS

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 09/702,726

(22) Filed: Nov. 1, 2000

(30) Foreign Application Priority Data

Nov. 4, 1999 (JP) ..... 11-313789

(51) Int. Cl.[7] ..... B41J 29/393; B41J 29/38
(52) U.S. Cl. ..... 347/19; 347/14
(58) Field of Search ..... 347/19, 14, 71, 347/8, 10, 11, 12, 15; 400/56

(56) References Cited

FOREIGN PATENT DOCUMENTS

| | | |
|---|---|---|
| EP | 0 813 973 | 12/1997 |
| EP | 0 869 007 | 10/1998 |
| EP | 0 895 869 | 2/1999 |
| EP | 0 936 573 | 8/1999 |
| JP | 2-2423373 | 9/1990 |
| JP | 10-119358 | 5/1998 |
| JP | 11-005343 | 1/1999 |

*Primary Examiner*—Lamson Nguyen
*Assistant Examiner*—Charles W. Stewart, Jr.
(74) *Attorney, Agent, or Firm*—Oblon, Spivak, McClelland, Maier & Neustadt, P.C.

(57) ABSTRACT

In an ink jet printer, the technique of the present invention prints a test pattern that includes dots created in a forward pass of main scan and dots created in a backward pass of the main scan, which are alternately arranged in a sub-scanning direction. After creation of dots in the forward pass, the printing process carries out sub-scan by a feeding amount that is half a nozzle pitch k on a print head and then creates dots in the backward pass. The dots created in the forward pass are not overlapped with the dots created in the backward pass. In the case of appropriate dot creation timings set for the forward pass and the backward pass of the main scan, the resulting dot row forms a straight line extending in the sub-scanning direction. In the case of the deviated dot creation timing, on the other hand, the resulting dot row is slightly jagged and has significant unevenness. The test pattern of the present invention enables the dot creation timing to be readily and accurately adjusted, based on the linearity of the dot row. In the case of a narrow nozzle pitch that causes overlapping of dots in the sub-scanning direction, only the selected nozzles are used to print a test pattern in which the adjoining dots are not contact with one another. The arrangement of the present invention effectively prevents a misalignment of dots and thereby improves the image quality of the resulting printed image.

13 Claims, 25 Drawing Sheets

PRINTING APPARATUS HAVING FUNCTION OF ADJUSTING POSITIONAL MISALIGNMENT OF DOTS

BACKGROUND OF THE INVENTION

1. Field of the Invention

The present invention relates to a printing apparatus that is capable of adjusting dot misalignment in a main scanning direction with respect to dots created at different times, for example, dots printed in a forward pass and a backward pass of main scan, and to a method of adjusting such a misalignment of dots.

2. Description of the Related Art

Ink jet printers that eject ink from a print head to implement printing have widely been used as the output device of the computer. The ink jet printer generally moves a print head forward and backward relative to a printing medium as its main scan and causes multiple color inks to be ejected from the print head to create dots. Some of the ink jet printers create dots both in a forward pass and a backward pass of the main scan to enhance the recording speed (hereinafter this recording method is referred to as the bi-directional printing). In order to print an image of good quality, the dots created in the forward pass should be aligned with the dots created in the backward pass in the main scanning direction. When there is misalignment between the dots created in the forward pass and the dots created in the backward pass, a resulting image has harshness and poor image quality. Adjustment using a test pattern is typically carried out to compensate for such dot misalignment.

FIG. 24 shows a prior art test pattern, which is created by a print head HD having five nozzles. The left side of the drawing shows the position of the print head HD in a sub-scanning direction on the occasion of the forward pass of the main scan, and the right side of the drawing shows the position of the print head HD in the sub-scanning direction on the occasion of the backward pass of the main scan. In the central portion of the drawing, dots created in the forward pass are shown by the open circles, whereas dots created in the backward pass are shown by the closed circles. The process of printing the prior art test pattern first creates dots in the forward pass of the main scan, carries out sub-scan by a feeding amount L, which corresponds to an integral multiple N of a nozzle pitch k, and then creates dots in the backward pass of the main scan. The timing of ejecting ink is shifted by a unit step at each pixel in the backward pass, so as to vary the positions of the dots created in the backward pass relative to those in the forward pass. In the example of FIG. 24, the ink ejection timing in the backward pass is shifted by one through five steps respectively as indicated by Nos. 1 through 5. The user observes the printed results of the test pattern and selects the optimum dot positions, so as to adjust the ink ejection timing to cause no misalignment between the dots created in the forward and backward pass. In the illustrated example of FIG. 24, at the timing No. 3, the positions of the dots created in the backward pass are coincident with the positions of the dots created in the forward pass. Namely the timing No. 3 is optimum.

In order to attain the high image quality, the printers developed recently carry out printing at high resolutions using very small dots. Use of the very small dots, however, lowers the printing, speed. It is thus highly demanded to improve the image quality in the technique of bi-directional printing that enhances the printing speed. In the case of bi-directional recording, a slight deviation of the dot positions significantly affects the image quality of the resulting printed image. For example, when the print head has the tendency of deviating the dot positions leftward in the forward pass of the main scan from left to right, the dot positions are deviated rightward in the backward pass of the main scan. Namely the deviation is doubled in the case of bi-directional recording. Since the inappropriate adjustment of the dot positions in the forward pass and the backward pass of the main scan results in the extremely poor image quality in the case of bi-directional printing, the development of the technique has been highly desired to readily and accurately adjust the dot creation timing.

As the fruits of intensive experiments and discussions, the applicant of the present invention has found that the accurate adjustment of the misalignment of dots created in the forward pass with dots created in the backward pass significantly improves the image quality of the resulting printed image, which is equivalent to a significant increase in printing resolution. The increase in printing resolution using the very small dots undesirably raises the manufacturing cost of the printer. The arrangement of accurately matching the positions of the dots created in the forward pass with the positions of the dots created in the backward pass, however, readily improves the image quality without any increase in manufacturing cost. From these viewpoints, the technique of readily and accurately adjusting the dot misalignment in the case of bi-directional printing has been desired eagerly.

The test pattern shown in FIG. 24, however, does not attain the adjustment of the sufficient accuracy that satisfies these requirements. FIG. 25 is an enlarged view showing a test pattern actually printed. In the example of FIG. 25, dots are recorded by varying the ink ejection timing by one through fifteen steps respectively as indicated by Nos. 1 through 15. In each row of the printed test pattern, the upper portion includes only the dots created in the forward pass, and the lower portion includes only the dots created in the backward pass. An intermediate portion includes both the dots created in the forward pass and the dots created in the backward pass, which are overlapped with each other. The printed results of the test pattern shown in FIG. 25 show that Nos. 4 through 9 are in a preferable range of the dot creation timing. It is, however, very difficult to identify the optimum dot creation timing in this preferable range. Namely the prior art test pattern is not capable of adjusting the dot positions with a sufficiently high accuracy. In this example, the respective dots are printed at a relatively low resolution that allows the visual recognition. In the case of printing at a high resolution that causes each dot row to form a continuous line in the sub-scanning direction, it is almost impossible to specify the optimum dot creation timing.

Development of the technique for accurately adjusting the dot positions is highly desired especially in the case of bi-directional recording. The needs are, however, not restricted in the bi-directional recording, but also arise in a uni-directional printing, such as in the case of adjustment between multiple print heads of different colors and in the case of adjustment between dots of different ink quantities.

SUMMARY OF THE INVENTION

The object of the present invention is thus to provide a technique that readily and accurately adjusts the positions of dots created at different timings in a main scanning direction.

At least part of the above and the other related objects is attained by a print control apparatus that generates print control data and causes a printer unit to print a test pattern based on the generated print control data. The printer unit carries out main scan and sub-scan and creates dots with a plurality of dot-forming elements that have different positions in a sub-scanning direction. The test pattern is used to detect a misalignment of a plurality of dots created in each pixel by driving the dot-forming elements at different times.

The test pattern satisfies: a condition that the plurality of dots are created in a plurality of pixels having an identical position in a main scanning direction but different positions in the sub-scanning direction; and a condition that dots created at one time are respectively interposed between dots created at another time in at least part of the test pattern.

The printer unit receives the print control data generated by the print control apparatus and carries out printing of the test pattern specified above.

Here the plurality of different times may regard a diversity of cases, for example, the case of ejecting ink in one pixel by a plurality of different passes of the main scan and the case of ejecting ink in one pixel at preset time intervals in an identical pass of the main scan.

In the case where the printer unit is capable of creating dots in both a forward pass and a backward pass of the main scan, the test pattern is printed to detect a misalignment of dots created in the forward pass with dots created in the backward pass.

In the case where the printer unit has the plurality of dot-forming elements arranged in the sub-scanning direction and in the main scanning direction in a two-dimensional manner, the test pattern is printed to detect a misalignment of dots created by dot-forming elements having different positions in the main scanning direction.

When the printer unit uses a plurality of different color inks, for example, the arrangement in the two-dimensional manner may have the dot-forming elements that are aligned in one direction, either in the main scanning direction or in the sub-scanning direction, with regard to each color and arrayed in the other direction for the different colors. In another example, the dot-forming elements of an identical color may be arrayed not only in the sub-scanning direction but in the main scanning direction.

In the case where each of the plurality of dot-forming elements has a mechanism that is capable of ejecting an ink droplet at a varying jet speed to create a dot of a varying ink quantity, the test pattern is printed to detect a misalignment of dots formed by ink droplets ejected at different jet speeds.

One mechanism applicable to allow creation of dots having different ink quantities provides the dot-forming elements that are capable of consecutively ejecting an ink droplet having a higher jet speed and an ink droplet having a lower jet speed in each pixel, and selectively uses either one of these ink droplets. The consecutive ejection in each pixel is not essential here.

In the test pattern of the present invention, dots are created in. pixels having an identical position in the main scanning direction. Namely each dot row extends in the sub-scanning direction. The respective dots in each dot row have different positions in the sub-scanning direction, and are thus not completely overlapped with one another. There is a specific area in which the dots created at one time are respectively interposed between the dots created at another time. In the case where all these dots are created at appropriate positions, dots in each dot row are perfectly aligned in the sub-scanning direction. In the case where the dot positions are deviated from the appropriate positions, however, the resulting dot row is slightly jagged and has significant unevenness compared with the normal straight line. Using this test pattern to check for the presence of such unevenness enables the dot positions to be readily and accurately adjusted.

FIG. 1 shows an exemplified test pattern following the principle of the present invention. Like the prior art test pattern, dots are created both in the forward pass (dots shown by the open circles) and in the backward pass (dots shown by the closed circles) with five dot-forming elements arrayed in the sub-scanning direction. Five dot rows having numerals 1 through 5 allocated thereto are formed by shifting the drive timing of the dot-forming elements in the backward pass of the main scan in five different stages. Each dot row corresponds to the test pattern satisfying the conditions specified above, so that printing of only one dot row may be sufficient. As clearly seen from the printed results, dots are created at appropriate positions at the timing No. 3. The resulting dot row accordingly forms a straight line in the sub-scanning direction. The other timings Nos. 1, 2, 4, and 5, on the other hand, cause some misalignment and the resulting dot rows accordingly have significant unevenness. Adjustment of the drive timing of the dot-forming elements in the backward pass to the state of the timing No. 3 enables dots to be created at appropriate positions.

FIG. 2 is an enlarged view showing a test pattern actually printed according to the technique of the present invention. This test pattern is printed under the same conditions as those applied for the prior art test pattern shown in FIG. 25. Unevenness of the dot row is conspicuously recognized at the timings No. 1 and No. 15 having the misalignment of the dot positions. At the timings Nos. 5 through 7, on the other hand, there is little unevenness and the resulting dot rows are practically straight. The careful observation proves that the timing No. 6 gives a dot row having the best linearity. While the prior art test pattern can not specify the optimum timing among the timings Nos. 4 through 9 in FIG. 25, the test pattern of the present invention enables specification of the optimum timing.

Using the test pattern of the present invention facilitates detection of a misalignment of dots, mainly because of the following factors. In the prior art test pattern (see FIGS. 24 and 25), the overlapping degree of the dots created in the forward pass and the dots created in the backward pass increases with a decrease in misalignment of dots. The dot row having the less misalignment is thus visually recognized as the thinner line. In other words, the prior art test pattern specifies a misalignment using the thickness of the dot row as the index. The vision of the human is, however, rather insensitive to the difference in thickness, and can not detect a slight misalignment with a high accuracy. When there is little misalignment, dots are almost completely overlapped with each other. Blotting or stain may occur at the overlapped position. The blotting tends to thicken the dot row and makes it more difficult to detect the misalignment. The test pattern of the present invention, on the other hand, detects the misalignment, based on the degree of unevenness or linearity of the dot row. The vision of the human is generally very sensitive to the unevenness or linearity. The arrangement of the present invention accordingly enhances the accuracy of detecting the misalignment.

FIGS. 1 and 2 show the test pattern including the dots created in the forward pass of the main scan and the dots created in the backward pass. The test pattern of the present invention is applicable to detect a misalignment between a plurality of different dots created at different times. The technique of the present invention is not restricted to the dots created at two different times, but is applicable to the dots created at three or more different times, for example, dots created by three or more dot-forming elements having different positions in the main scanning direction. Although the dots are arranged at equal intervals in the sub-scanning direction in the example of FIGS. 1 and 2, the dots may be arranged at irregular intervals.

A variety of values may be set to the feeding amount of sub-scan in the process of printing the test pattern of the present invention.

For example, when the printer unit has the dot-forming elements at a pitch of k raster lines in the sub-scanning direction, where k is a natural number of not less than 2, the print control data causes the printer unit to carry out the sub-scan by a feeding amount. of s-k/m raster lines and print the test pattern, in order to detect a misalignment of dots created at m different times, where m is a natural number of not less than 2, s is equal to 1 or a natural number prime to the natural number m.

In this application, the printed test pattern includes dots arranged at equal intervals in the sub-scanning direction.

The test pattern of the present invention is used to detect the misalignment of dots, based on the unevenness or linearity of the dot row. It is accordingly desirable that the respective dots are individually recognizable. From this point of view, it is preferable that the test pattern includes dots arranged at such an interval that adjoining dots in the sub-scanning direction are not in contact with each other, although the test pattern is not restricted to this arrangement.

In the case where there is a sufficient interval between the adjoining dot-forming elements arrayed in the sub-scanning direction, all the dot-forming elements may be used to create dots in such a manner that the adjoining dots are not even partly overlapped with one another. In the case where the interval between the adjoining dot-forming elements is relatively narrow, there is a possibility of overlapping the adjoining dots. In this case, the test pattern may be printed by using only part of the plurality of dot-forming elements, which are not adjacent to one another. This arrangement gives a test pattern that ensures the accurate adjustment of the dot positions even when the dot-forming elements are arranged at an extremely high density for printing of the high resolution.

The drive timing of the printer unit may be regulated in a repeated manner while the test pattern is printed.

In accordance with one preferable application of the present invention, the print control apparatus further includes: a timing specification unit that causes a user to specify a desired drive timing of the dot-forming elements at each of the different times, based on the printed test pattern; and a modification instructing data generation unit that generates modification instructing data as data supplied to the printer unit to modify a preset drive timing of the dot-forming elements with the specified drive timing.

This arrangement enables the drive timing of the printer unit to be regulated to the appropriate value, based on the modification instructing data. It is also desirable that the printer unit has means for modifying the drive timing of the dot-forming elements based on the modification instructing data. When the drive timing of the dot-forming elements is directly controllable by the print control unit, the print control unit may execute a control procedure to modify the drive timing of the dot-forming elements with the timing specified by. the user.

The technique of the present invention is attained by a variety of applications other than the print control apparatus discussed above; for example, a printing system including a printer unit and the print control apparatus, a print controlling method, and a printing method, which follow the same primary concepts.

The technique of the present invention is also actualized by a recording medium, in which a program for causing the computer to carry out the functions discussed above is recorded in a computer readable manner. Typical examples of the recording medium include flexible disks, CD-ROMs, magneto-optic discs, IC cards, ROM cartridges, punched cards, prints with barcodes or other codes printed: thereon, internal storage devices (memories like a RAM and a ROM) and external storage devices of the computer, and a variety of other computer readable media. The present invention may also be directed to a program itself for attaining the functions discussed above, test pattern data, and a variety of equivalent signals.

These and other objects, features, aspects, and advantages of the present invention will become more apparent from the following detailed description of the preferred embodiments with the accompanying drawings.

DESCRIPTION OF THE PREFERRED EMBODIMENTS

Figure 3:
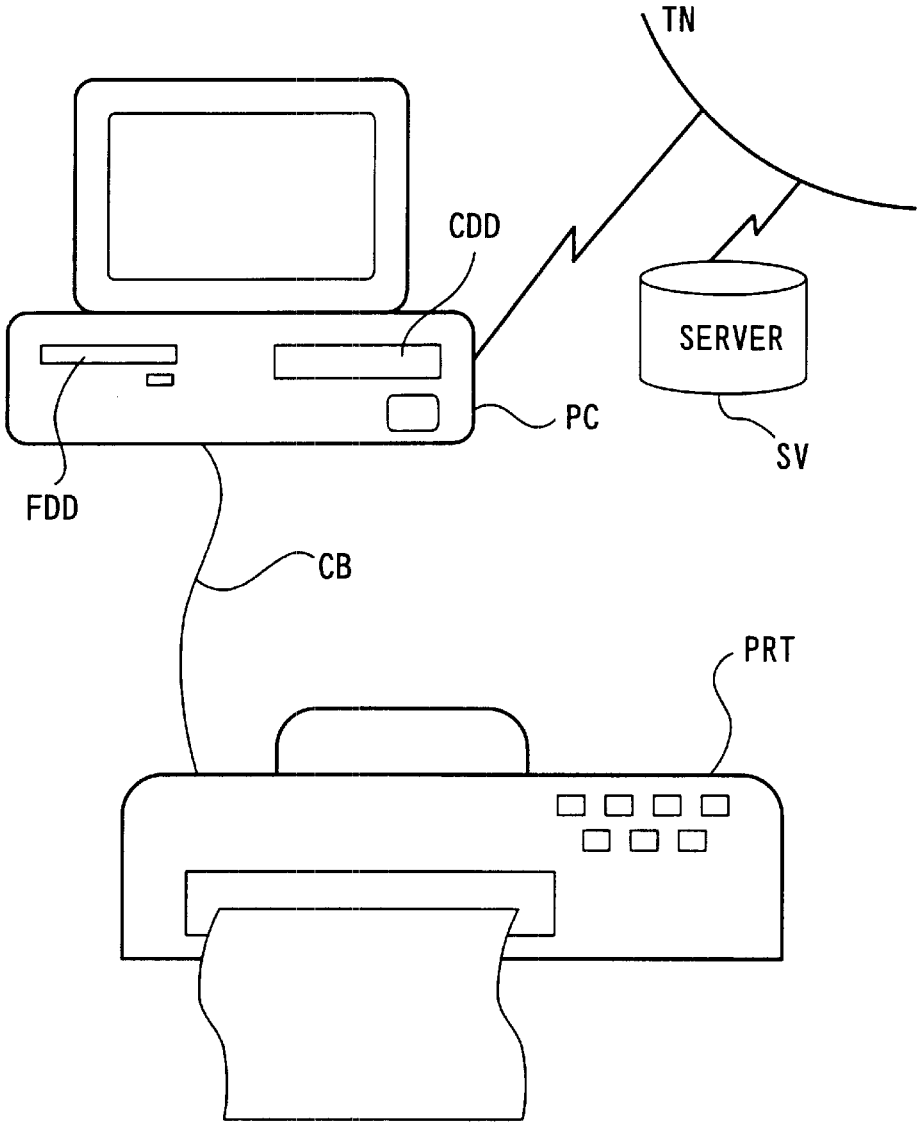
FIG. 3 illustrates the structure of a printing system in one embodiment of the present invention.

Some modes of carrying out the present invention are described below as preferred embodiment in the following sequence:

A. Structure of Apparatus
B. Dot Creation Timing Adjustment Process
C. Second Embodiment
D. Third Embodiment
E. First Modification of Third Embodiment
F. Second Modification of Third Embodiment A. Structure of Apparatus FIG. 3 illustrates the structure of a printing system in one embodiment of the present invention. This printing system includes a computer PC connected with a printer PRT via a cable CB. The printer PRT is an ink jet printer that carries out main scan and sub-scan and ejects ink to create dots and thereby print an image. The computer PC generates print control data, which specify operations of the printer PRT, and transfers the print control data to the printer PRT. The print control data include raster data that specify the dot on-off state with regard to each pixel on each raster line and feed amount data that specify a feeding amount of the sub-scan. The computer PC executes the software called a printer driver to generate the print control data.

The computer PC is connected to an external network TN and may gain access to a specific server SV to download programs and data required for driving the printer PRT. The required programs and data may alternatively be loaded from a recording medium, such as a flexible disk or a CD-ROM set in a flexible disk drive FDD or a CD-ROM drive CDD. The series of programs required for printing may be loaded as a whole, or only part of the programs may be loaded as modules.

Figure 4:
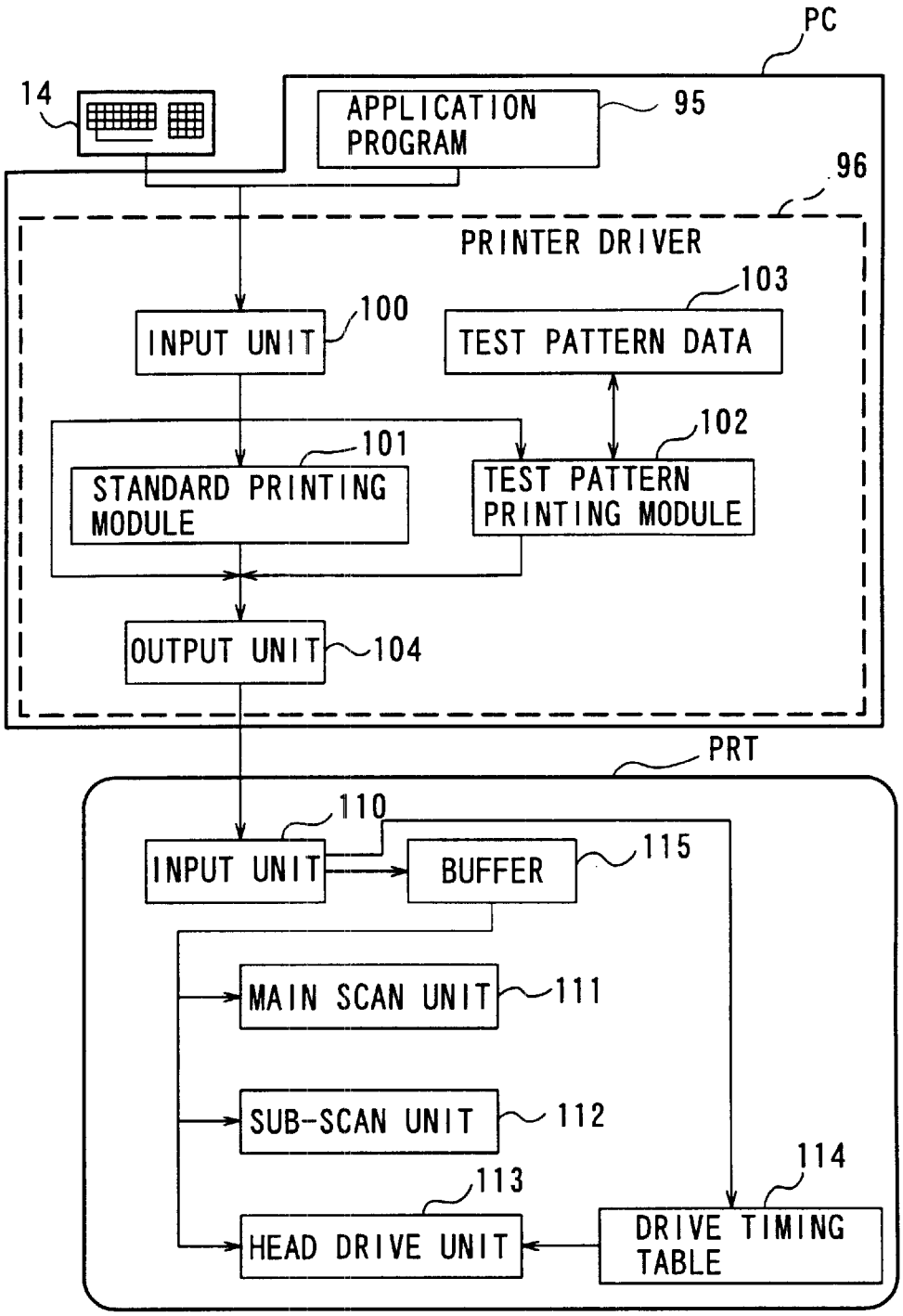
FIG. 4 shows functional blocks in the printing system of the embodiment.

FIG. 4 shows functional blocks in the printing system of the embodiment. In the computer PC, an application program 95 works under a predetermined operating system. A printer driver 96 is incorporated in the operating system. The application program 95. carries out series of processing like generation and retouching of images.

The printer driver 96 receives a variety of commands through operations of a keyboard 14 and a variety of instructions including a printing instruction from the application program 95 via an input unit 100. The printer driver 96 executes a required series of processing in response to the input. For example, in response to a printing instruction from the application program 95, the printer driver 96 first receives image data from the application program 95 via the input unit 100 and drives a standard printing module 101 to generate print control data, which are used to control operations of the printer PRT. The standard printing module 101 carries out color correction that converts the color components of the input image data into color components corresponding to inks used in the printer PRT, and halftone processing to express the tone values of the input image data as a distribution of dots. The standard printing module 101 then arranges the processed data together with feed amount data of the sub-scan in a predetermined format. The print control data arranged in the predetermined format are transferred to the printer PRT via an output unit 104.

One of the processes executed by the printer driver 96 in response to the commands input through the operations of the keyboard 14 adjusts the dot creation timing in the printer PRT. In response to a command of adjusting the dot creation timing, the printer driver 96 drives a test pattern printing module 102 to print a test pattern according to test pattern data 103 stored in advance. The print control data for printing the test pattern are output from the output unit 104 to the printer PRT. In this embodiment, the data directly transferable to the printer PRT are provided as the test pattern data 103. One possible modification provides the test pattern data 103 in the same format as that applied to the image data processed by the standard printing module 101, and drives the test pattern printing module 102 to carry out the color correction and the halftone processing and generate the print control data.

In the printer PRT, the print control data transferred from the printer driver 96 are received by an input unit 110 and temporarily stored in a buffer 115. A main scan unit 111 and a sub-scan unit 112 respectively carry out main scan of a print head and feed of printing paper according to the print control data stored in the buffer 115. A head drive unit 113 then drives the print head to print an image. The printer PRT is capable of creating dots in both a forward pass and a backward pass of the main scan. The timings of driving the print head are registered in a drive timing table 114.

In the process of adjusting the dot creation timing, the user specifies an appropriate timing through an operation of the keyboard 14, based on the printed results of the test pattern. The printer driver 96 receives the specified dot creation timing via the input unit 100 and outputs a control signal to the printer PRT to modify the contents of the drive timing table 114 with the input dot creation timing. When the input unit 110 of the printer PRT receives this control signal, the contents of the drive timing table 114 are rewritten to the newly specified dot creation timing. In this embodiment, the printer PRT prints the test pattern based on the print control data generated by the computer PC. Some of the functions attained by the computer PC may, however, be incorporated in the printer PRT.

Figure 5:
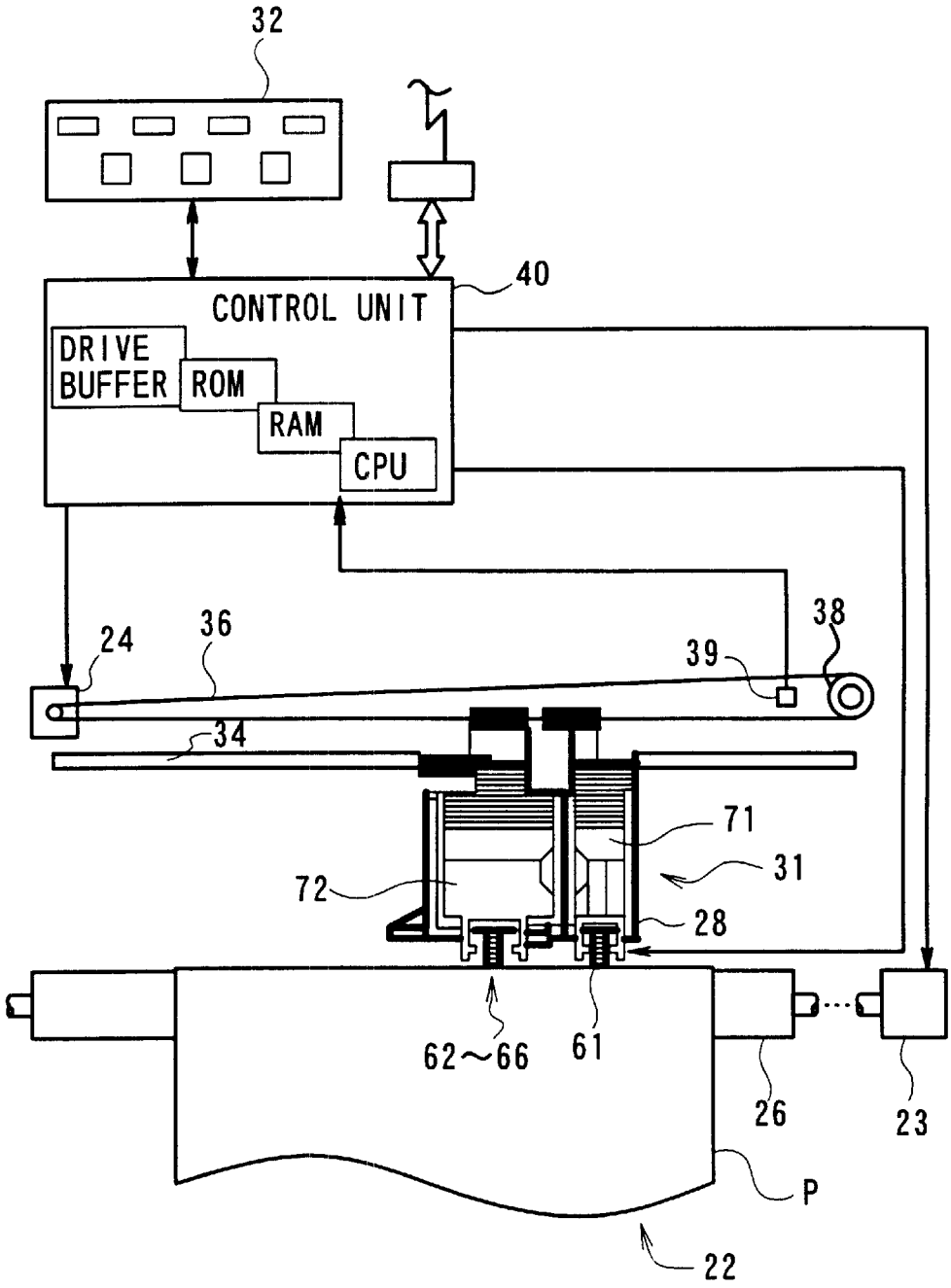
FIG. 5 schematically illustrates the structure of a printer included in the printing system of the embodiment.

FIG. 5 schematically illustrates the structure of the printer PRT. The printer PRT has a circuit of driving a sheet feed motor 23 to feed a sheet of printing paper P, a circuit of driving a carriage motor 24 to move a carriage 31 forward and backward along an axis of a platen 26, a circuit of driving a print head 28 mounted on the carriage 31 to implement ink ejection and dot creation, and a control unit 40 that controls transmission of signals to and from the sheet feed motor 23, the carriage motor 24, the print head 28, and a control panel 32.

The circuit of reciprocating the carriage 31 along the axis of the platen 26 includes a sliding shaft 34 that is disposed in parallel with the axis of the platen 26 for slidably supporting the carriage 31, a pulley 38, an endless drive belt 36 that is spanned between the carriage motor 24 and the pulley 38, and a position sensor 39 that detects the position of the origin of the carriage 31.

A black ink cartridge 71 for black ink (K) and a color ink cartridge 72 in which five color inks, that is, cyan (C), light cyan (LC), magenta (M), light magenta (LM), and yellow (Y), are accommodated are detachably attached to the carriage 31 in the printer PRT. A total of six ink ejection heads 61 through 66 are formed on the print head 28 that is disposed in the lower portion of the carriage 31. Ink. conduits 68 are formed in the bottom of the carriage 31 to lead supplies of inks from ink reservoirs to the respective ink ejection heads.

Figure 6:
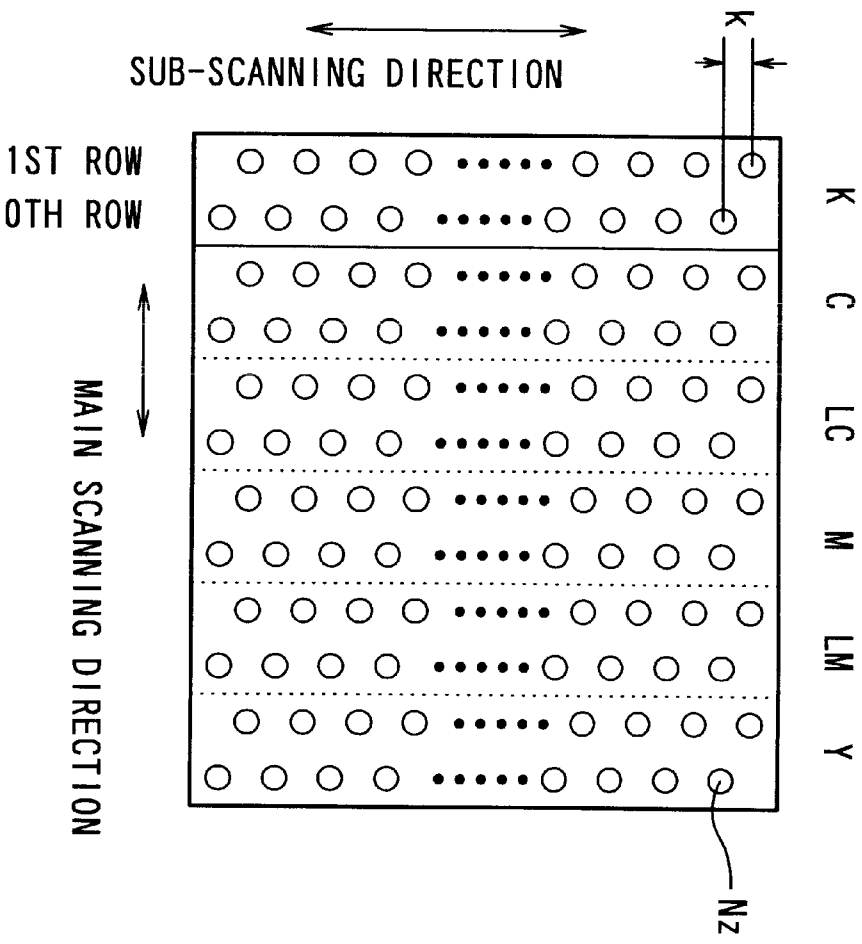
FIG. 6 shows an arrangement of nozzles Nz in ink ejection heads formed on a print head of the printer.

FIG. 6 shows an arrangement of nozzles Nz in the respective ink ejection heads 61 through 66. Each nozzle Nz represents a dot-forming element. The arrangement of nozzles shown in FIG. 6 includes six nozzle arrays, wherein each nozzle array ejects ink of each color and includes forty-eight nozzles Nz arranged in zigzag at a fixed nozzle pitch k. The positions of the corresponding nozzles in the respective nozzle arrays are coincident with one another in a sub-scanning direction. Namely each of the ink ejection heads 61 through 66 has a nozzle array consisting of two nozzle rows in a main scanning direction. In this embodiment, the nozzle pitch k is equal to an interval corresponding to a resolution of 90 dpi.

Figure 7:
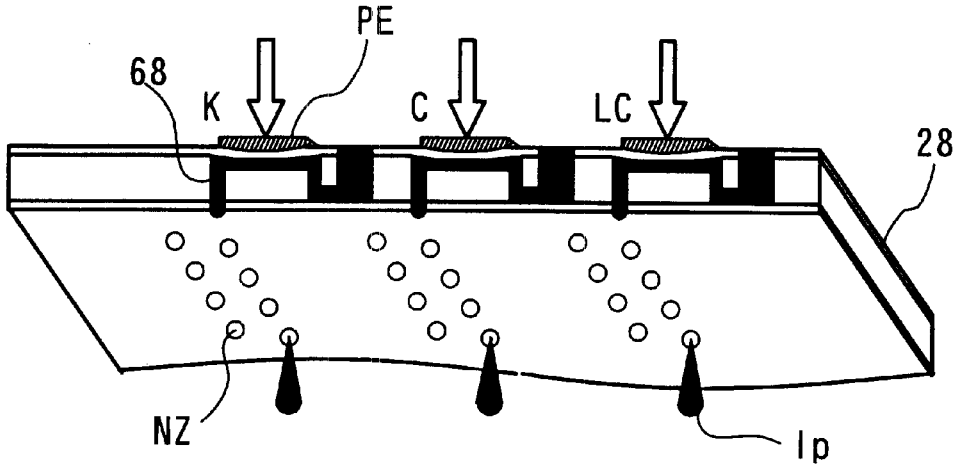
FIG. 7 shows the principle of dot creation by the print head.

FIG. 7 shows the principle of dot creation by the print head 28. For the clarity of illustration, only the part relating to the ink ejection with regard to the black (K), cyan (C), and light cyan (LC) inks is illustrated in FIG. 7. In the ink ejection heads 61 through 66, a piezoelectric element PE is arranged corresponding to each nozzle Nz. When a preset voltage is applied between electrodes on either end of the piezoelectric element PE for a predetermined time period, the piezoelectric element PE is expanded for the predetermined time period to deform one side wall of the ink conduit 68 as shown by the arrow in FIG. 7. The volume of the ink conduit 68 is reduced according to the expansion of the piezoelectric element PE. A certain amount of ink corresponding to the reduction is then ejected as an ink particle Ip from the nozzle Nz.

Figure 8:
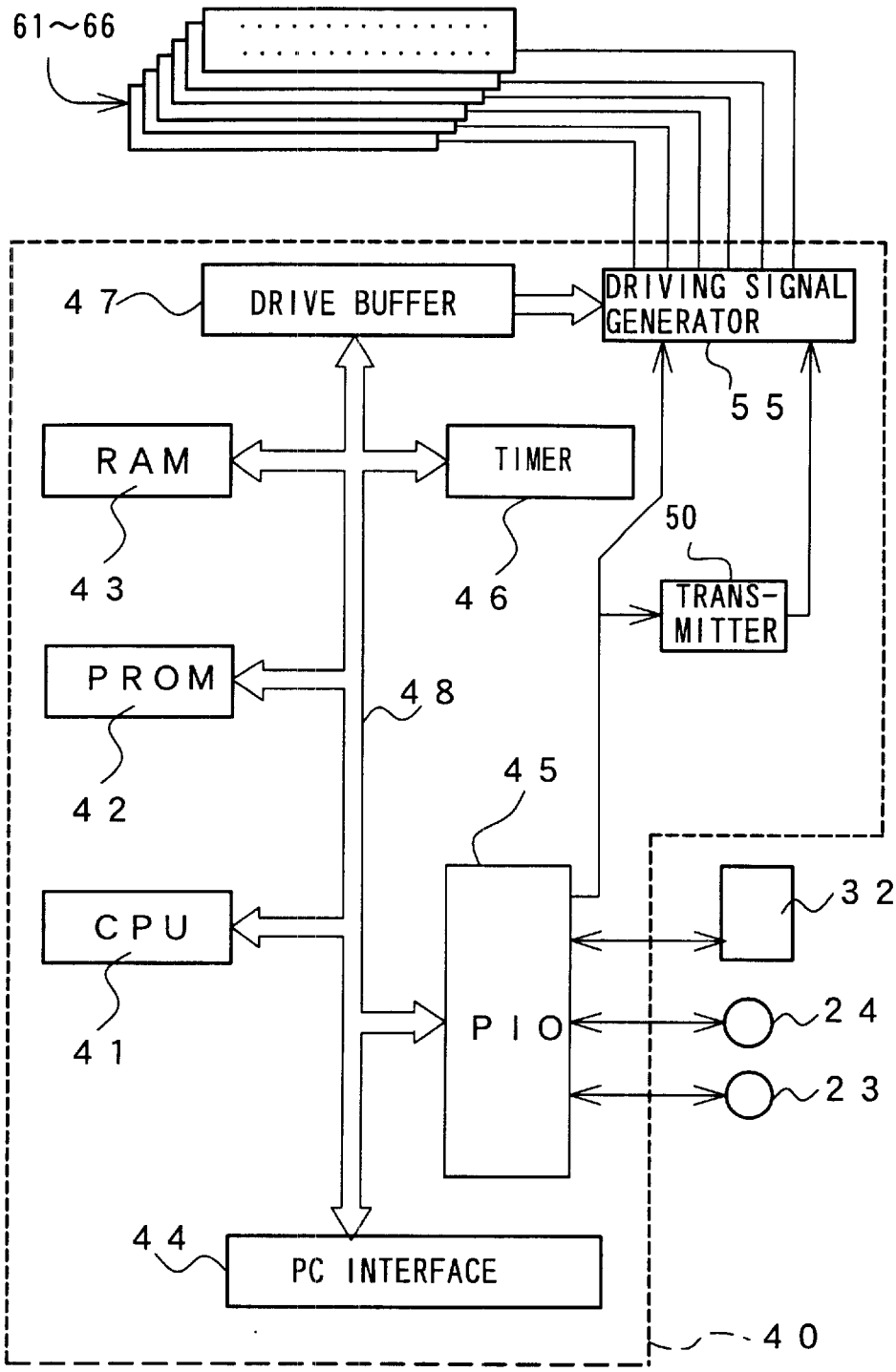
FIG. 8 shows the internal structure of a control unit included in the printer of FIG. 5.

The following describes the internal structure of the control unit 40. FIG. 8 shows the internal structure of the control unit 40. The control unit 40 includes a CPU 41, a PROM 42, a RAM 43, and a diversity of circuits discussed below, which are mutually connected via a bus 48. A PC interface 44 is in charge of transmission of data to and from the computer PC. A peripheral input-output unit (PIO) 45 is in charge of transmission of signals to and from the sheet feed motor 23, the carriage motor 24, and the control panel 32. A clock 46 synchronizes the operations of the respective circuits included in the control unit 40. A drive buffer 47 activates a driving signal generator 55 to output signals representing the dot on-off state of the respective nozzles to the ink ejection heads 61 through 66.

A transmitter 50 is connected with the driving signal generator 55. The transmitter 50 periodically outputs a clock signal, which works as a reference signal in the process of generating the driving signal. The driving signal generator 55 generates driving waveforms to be output to the respective nozzle rows of the ink ejection heads 61 through 66, based on the clock signal output from the transmitter 50. As mentioned previously, the ink ejection heads 61 through 66 totally have twelve nozzle rows having different positions in the main scanning direction. The driving signal generator 55 accordingly outputs the driving signal at different timings successively shifted: with regard to each nozzle row, in order to ensure adequate creation of dots in the respective pixels. Since the printer PRT adopts the technique of bidirectional recording, the output timing of the driving signal, that is, the dot creation timing, is set individually for the forward pass and the backward pass of the main scan. The output timings of the driving signal are stored in the PROM 42.

Figure 9:
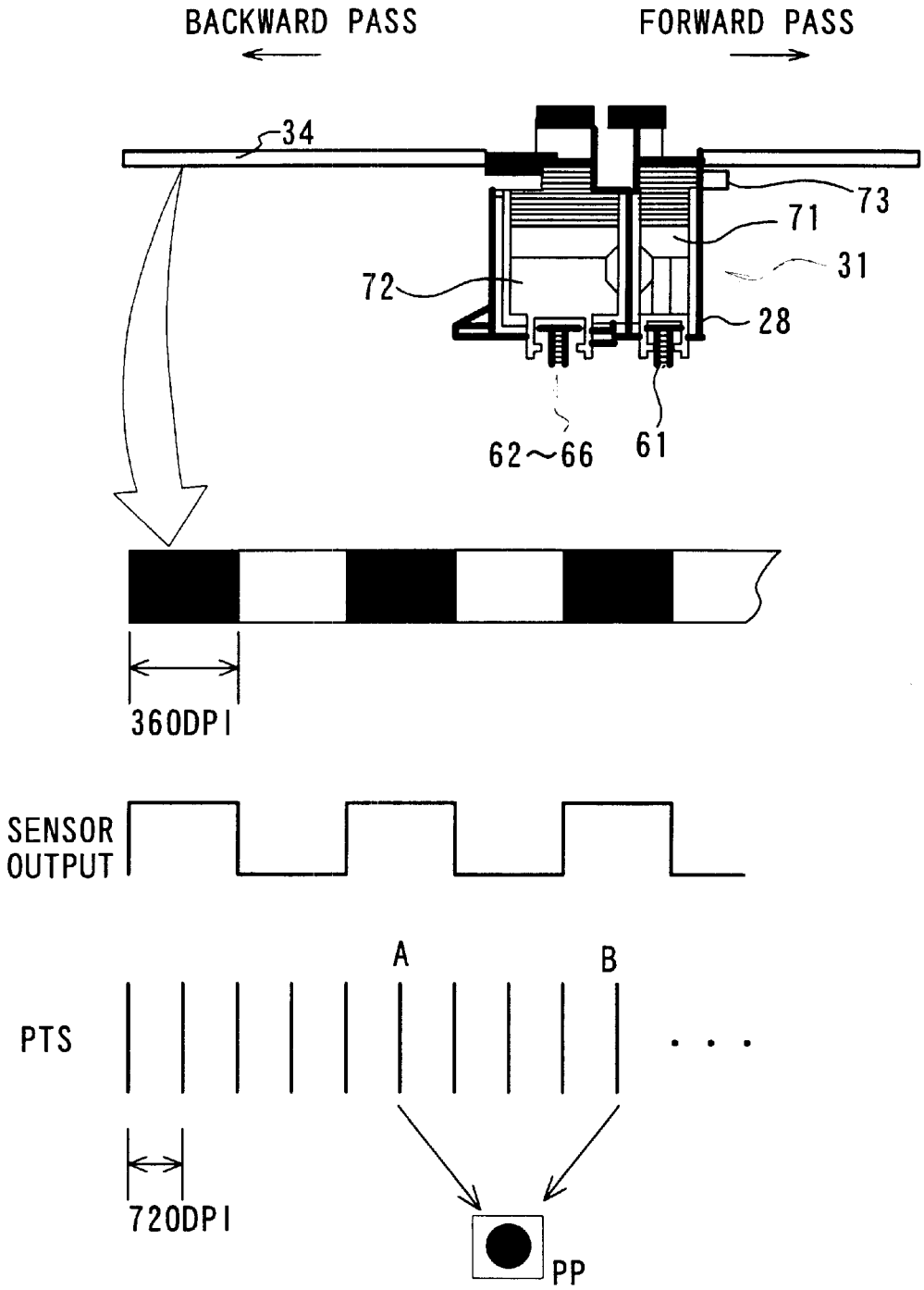
FIG. 9 shows generation of a PTS signal.

The following describes the definition of the output timing of the driving signal. The output timing of the driving signal is specified by an interval from a PTS signal. The PTS signal is output corresponding to each pixel and sets a reference output timing. FIG. 9 shows generation of the PTS signal. The sliding shaft 34 of the printer PRT has a linear scale, on which painted parts are arranged at preset equal intervals. In this embodiment, the width of each painted part is equal to an interval of 360 dpi, which corresponding to twice the printing resolution in the main scanning direction. An optical sensor 73 is mounted on the carriage 31 and outputs an on-off state signal according to the facing part, that is, either the filled part or the open part faces the optical sensor 73, in the course of a movement of the carriage 31. The output signal from the optical sensor 73 is also shown in FIG. 9. The control unit 40 detects the position of the carriage 31 in the main scanning direction, based on this output pulse.

The position of the carriage 31 may be specified with a greater resolution by equally dividing the pulse output from the optical sensor 73. For example, in the case where the interval of the output pulse is divided into two equal parts, the position of the carriage 31 is specified with a resolution of 720 dpi. The resulting signal holds a fixed relationship between the carriage 31 and each pixel. In the case of printing at the resolution of 720 dpi, the resulting signal functions as the PTS signal. FIG. 9 shows the PTS signal corresponding to the resolution of 720 dpi. The method of generating the PTS signal is not restricted to the arrangement using the optical sensor. The PTS signal may be output at fixed time intervals from the beginning of the main scan. In the case where the carriage is driven by a stepping motor, the PTS signal may be generated in response to the pulse output to the stepping motor.

In order to create a dot in a pixel PP of interest in the forward pass of the main scan, ink should be ejected in response to a PTS signal A. Similarly ink should be ejected in response to a PTS signal B to create a dot in the pixel PP in the backward pass of the main scan. In either case, it is not required to eject ink simultaneously with the output of the PTS signal, but ink is ejected after a preset interval from the PTS signal to create a dot in the pixel of interest PP. In the specification hereof, the interval between the output of the reference PTS signal and the output of the driving signal is referred to as the output timing of the driving signal.

Figure 10A:
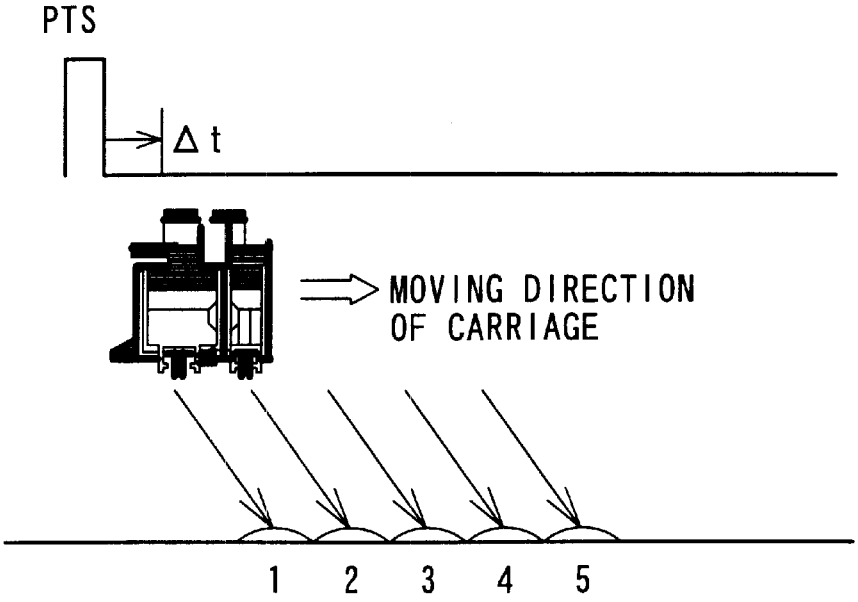
FIG. 10A and FIG. 10B show a variation in dot creating position with a shift of the output timing.
Figure 10B:
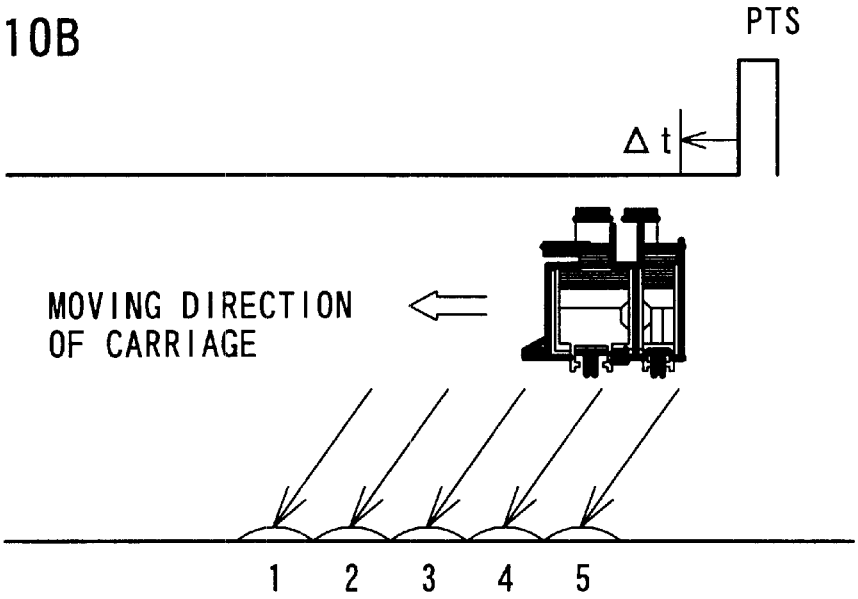

FIG. 10A and FIG. 10B show a variation in dot creating position with a shift of the output timing. FIG. 10A shows creation of dots when the carriage moves rightward. When a driving signal is output at an output timing delayed by a time $\Delta t$ from the PTS signal, a dot is created at position 1. The ink ejection timing is gradually delayed with an increase in time $\Delta t$, so that the dot creating position is shifted rightward from position 1 to position 5. FIG. 10B shows creation of dots when the carriage moves leftward. When a driving signal is output at an output timing delayed by the time $\Delta t$ from the PTS signal, a dot is created at position 5. The dot creating position is shifted leftward from position 5 to position 1 with an increase in time $\Delta t$. In the case where the dot creating position is to be shifted rightward, the ink ejection timing should be delayed while the carriage moves rightward, but should be advanced while the carriage moves leftward.

The printing system of the embodiment having the configuration discussed above enables the dot positions to be adjusted by regulating the output timing of the driving signal using a printed test pattern.

B. Dot Creation Timing Adjustment Process

Figure 11:
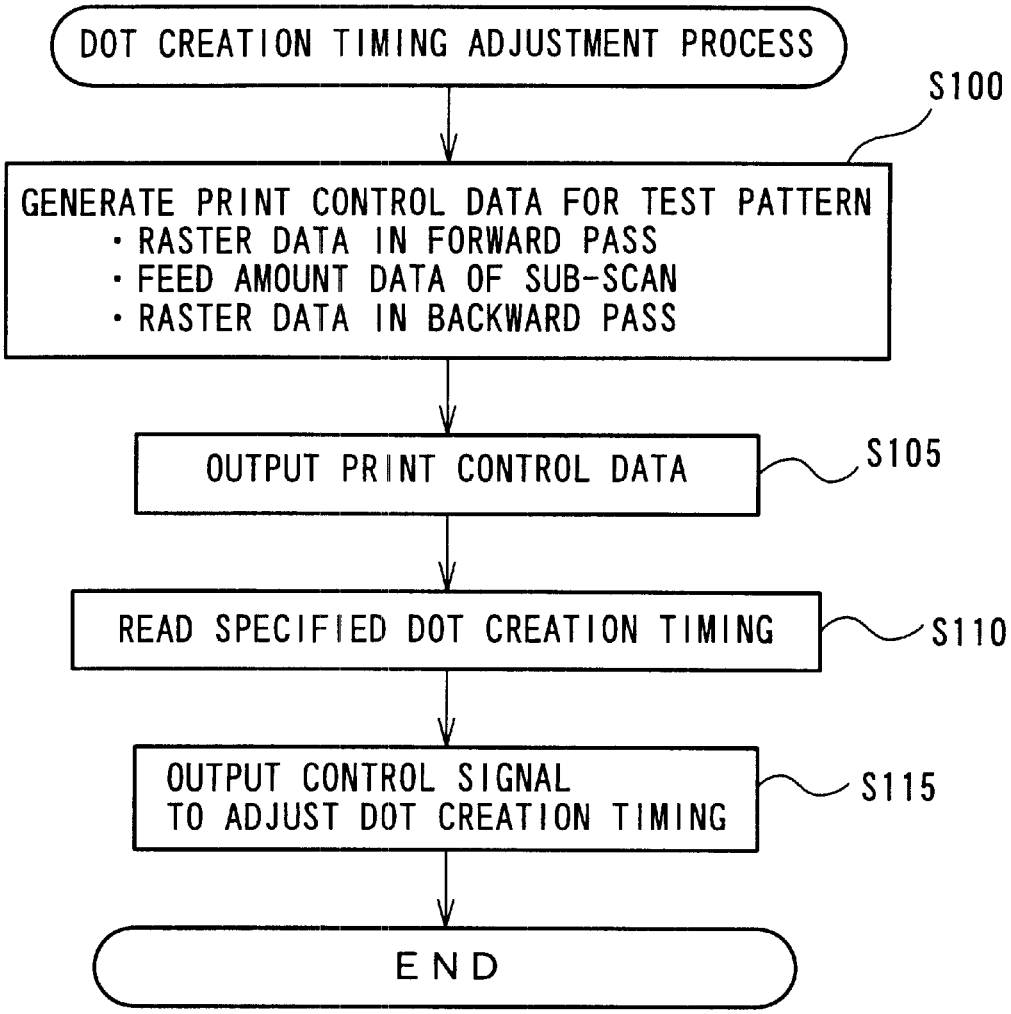
FIG. 11 is a flowchart showing a dot creation timing adjustment routine executed in embodiment.

In the case of bi-directional recording, the following process is executed to adjust the dot creation timing. The adjustment is implemented by executing a dot creation timing adjustment routine in the printer driver 96. FIG. 11 is a flowchart showing the dot creation timing adjustment routine, which is carried out by the CPU of the computer PC. In the exemplified flow of FIG. 11, the dot creation timing with regard to the black (K) ink is adjusted in the forward pass and the backward pass of the main scan.

When the dot creation timing adjustment process starts, the CPU first generates the print control data, which are used to print a test pattern, at step S100, and outputs the generated print control data to the printer PRT at step S105. In accordance with a concrete procedure, the CPU generates raster data specifying the dot positions in the forward pass of the main scan, feed amount data specifying a feeding amount of the sub-scan, and raster data specifying the dot positions in the backward pass of the main scan, based on a test pattern data stored in advance, outputs the raster data and the feed amount data as the print control data.

Figure 1:
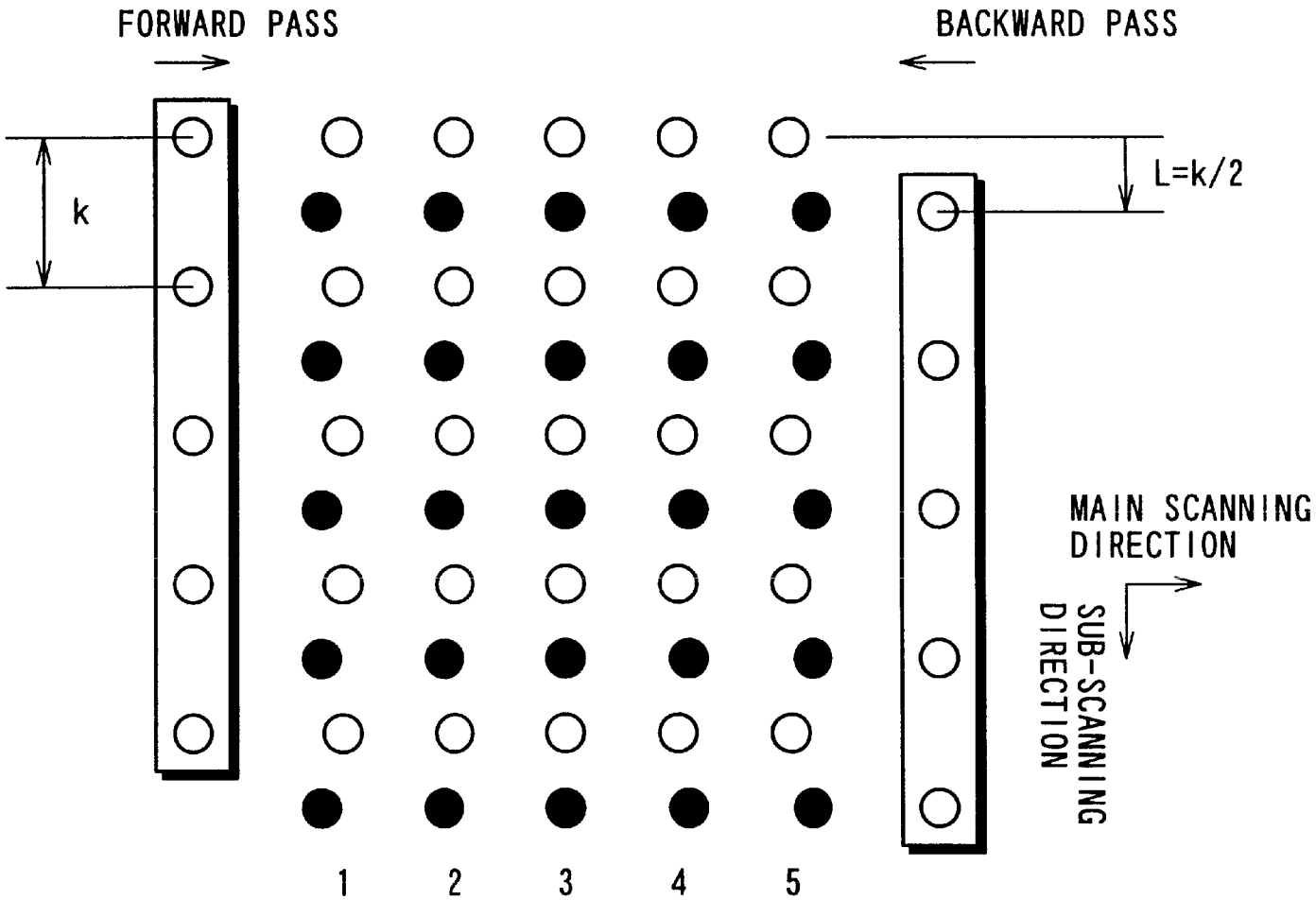
FIG. 1 shows an exemplified test pattern following the principle of the present invention.

FIG. 1 shows a test pattern used in this embodiment. The illustrated test pattern is printed with a print head having five nozzles arrayed in the sub-scanning direction. As discussed previously, dots are created at the positions shown by the open circles in the forward pass of the main scan. Respective rows of the test pattern having numerals 1 through 5 allocated thereto are formed at suitable intervals that do not cause any overlapping but ensure easy discrimination. In the forward pass of the main scan, dots are created at a fixed timing relative to the PTS signal. After creation of dots in the forward pass, the sub-scan is carried out by a feeding amount L, which corresponds to half a nozzle pitch k. Dots are then created at the positions shown by the closed circles in the backward pass of the main scan. The dots created in the backward pass are respectively interposed between the dots created in the forward pass. In the backward pass of the main scan, dots are created at a plurality of different timings relative to the PTS signal. In this example, the dot creation timing is shifted in five different stages. This results in varying the dot creating position in the backward pass relative to the dot creating position in the forward pass in five different stages. Like the numerals 1 through 5, an identification number is allocated to the printed test pattern at each timing. The printed test pattern in this embodiment has the dot row, where the dots created in the forward pass and the dots created in the backward pass are alternately arranged.

Figure 2:
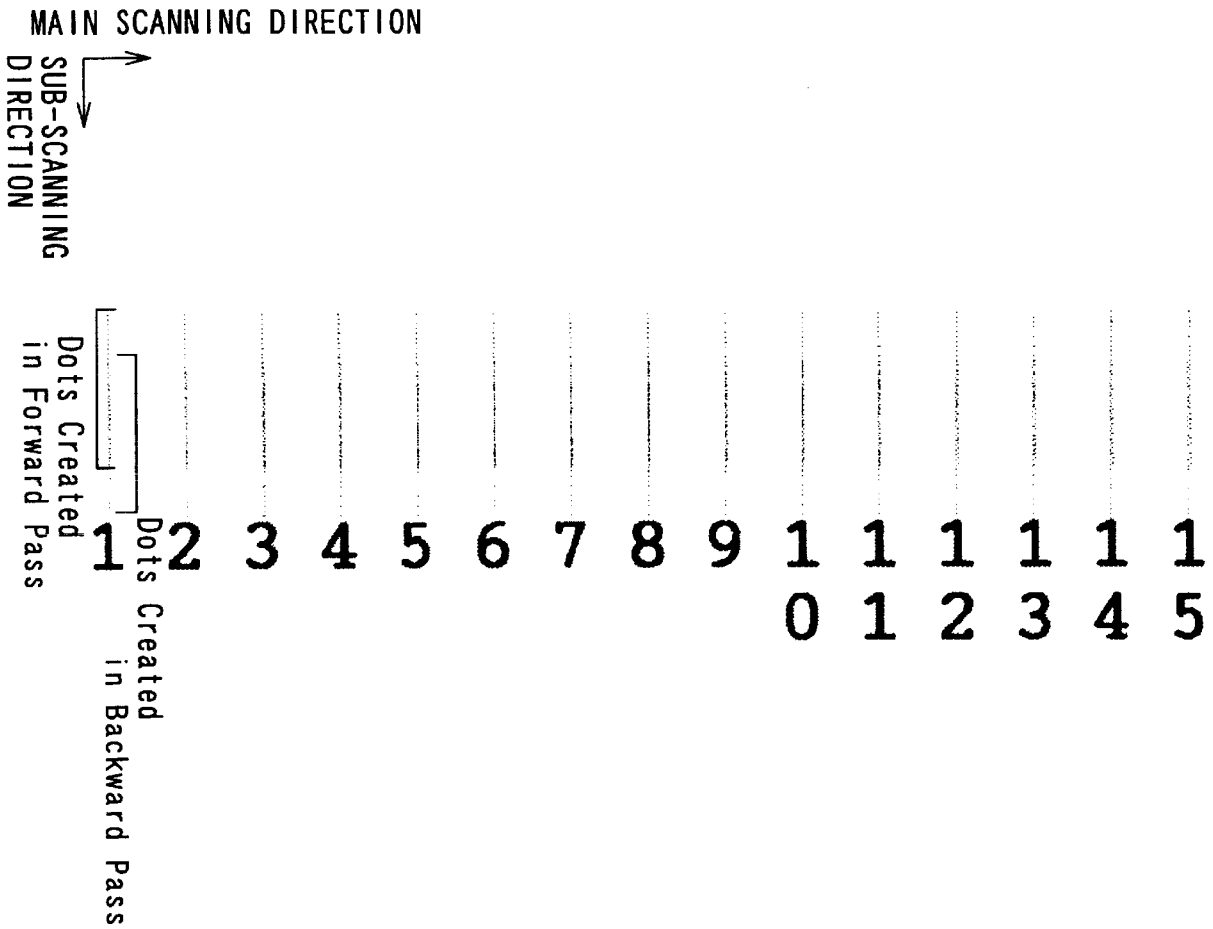
FIG. 2 is an enlarged view showing a test pattern actually: printed according to the technique of the present invention.

FIG. 2 is an enlarged view showing a test pattern actually printed according to the technique of this embodiment. In the example of FIG. 2, the feeding amount is set equal to 'half the nozzle pitch k×a factor of an odd number'. In each row of the printed test pattern, the upper portion includes only the dots created in the forward pass, and the lower portion includes only the dots created in the backward pass. An intermediate portion includes both the dots created in the forward pass and the dots created in the backward pass, which are arranged alternately in the sub-scanning direction. The feeding amount may be set equal to any value that prevents the dots created in the forward pass from being overlapped with the dots created in the backward pass in the area where these dots are mixed. The user may set an appropriate value to the feeding amount, in order to facilitate detection of a misalignment of dots. 'Half the nozzle pitch k×a factor of an odd number' is not an essential condition. It may be one third of the nozzle pitch k. The setting of 'half the nozzle pitch k×a factor of an odd number', however, enables the dots created in the forward pass and the dots created in the backward pass to be arranged at equal intervals. This arrangement facilitates detection of a misalignment of dots.

After printing the test pattern, the CPU waits for the user's specification of the dot creation timing and reads the specified dot creation timing at step S110. In this embodiment, the user inputs an identification number allocated to the desirable printed result of the test pattern, so as to specify the optimum dot creation timing. In accordance with a concrete procedure, the user selects the timing having least misalignment of dots created in the forward pass with dots created in the backward pass, based on the printed results of the test pattern, and inputs an identification number allocated to the selected timing. In the example of FIG. 1, the timing No. 3 is optimum, so that the user inputs the identification number 3 to the computer PC through an operation of the keyboard 14 or another appropriate input device.

After the specification of the optimum dot creation timing, the CPU outputs a control signal to adjust the drive timing data stored in the PROM of the printer PRT to a value corresponding to the specified dot creation timing at step S115. The printer PRT receives this control signal and modifies the contents of the drive timing table 114 stored in the PROM of the control unit 40. When the contents of the drive timing table 114 are modified, the interval between the output of the PTS signal and the output of the driving signal is changed in a next cycle of printing. Dots are accordingly created under the condition of the least misalignment of dots created in the forward pass with dots created in the backward pass.

As discussed above, the printing system of this embodiment utilizes the test pattern having the configuration specified in FIGS. 1 and 2 and thus enables the dot positions in the backward pass to be coincident with the dot positions in the forward pass with high accuracy. The printing system of this embodiment detects the misalignment based on the linearity of the dot row extending in the sub-scanning direction. The vision of the human is highly sensitive to such linearity and thereby ensures the accurate adjustment of the dot positions. The printing system of the embodiment thus effectively reduces the harshness of the resulting printed image and remarkably improves the image quality of the resulting printed image.

The above embodiment regards the arrangement that prints the test pattern at the varying dot creation timings and enables the user to input the desired identification number, so as to specify the optimum dot creation timing. The adjustment of the dot creation timing is, however, not restricted to this procedure. One modified application repeatedly executes specification of a single dot creation timing and printing of the test pattern at the specified dot creation timing, so as to eventually adjust the dot creation timing to the optimum state.

C. Second Embodiment

In the first embodiment, the nozzle pitch in the sub-scanning direction corresponds to the resolution of 90 dpi. As described previously with FIG. 9, the printer PRT of the embodiment carries out printing at the resolution of 720 dpi. Namely the nozzle pitch in the sub-scanning direction is several times sparser than the printing resolution in the structure of the first embodiment. The second embodiment, on the other hand, regards an arrangement that prints a test pattern and adjusts the dot creation timing under the condition of a narrower nozzle pitch in the sub-scanning direction, that is, with nozzles arrayed at a higher density in the sub-scanning direction.

Figure 12:
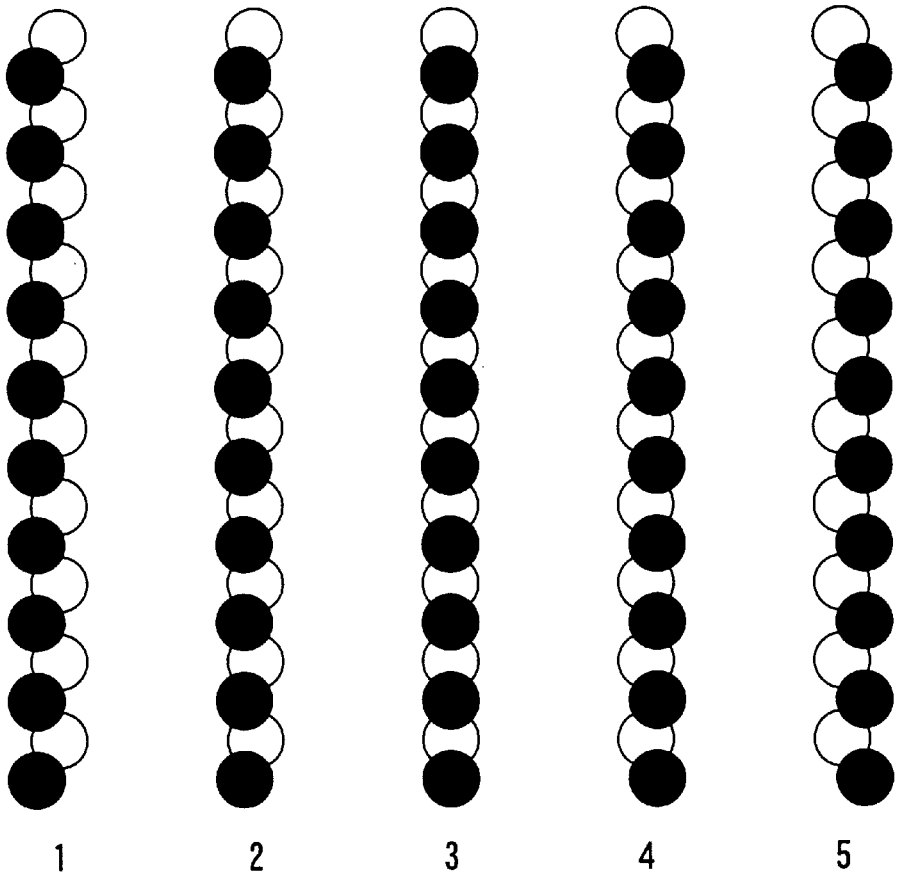
FIG. 12 shows a test pattern printed with nozzles arrayed at a high density.

FIG. 12 shows a test pattern printed with nozzles arrayed at a high density. In the example of FIG. 12, the nozzle pitch corresponds to 360 dpi, which is half the printing resolution 720 dpi in the sub-scanning direction. When the test pattern is printed with all the nozzles as in the case of the first embodiment, dots are crated in both the forward pass and the backward pass without any dropout in the raster line. The resulting dot row accordingly forms a continuous line extending in the sub-scanning direction. The test pattern shown in the first embodiment is used to detect a misalignment of dots, based on the linearity of dots, that is, the unevenness of the dot row. In the case where dots are created densely to make the resulting dot. row visually recognized as a continuous line, detection of the unevenness becomes rather difficult. This undesirably lowers the accuracy of adjustment of the dot positions. The printing system of the second embodiment prints a test pattern in the following manner to enable accurate adjustment of the dot positions with the nozzles arrayed at the higher density.

Figure 13:
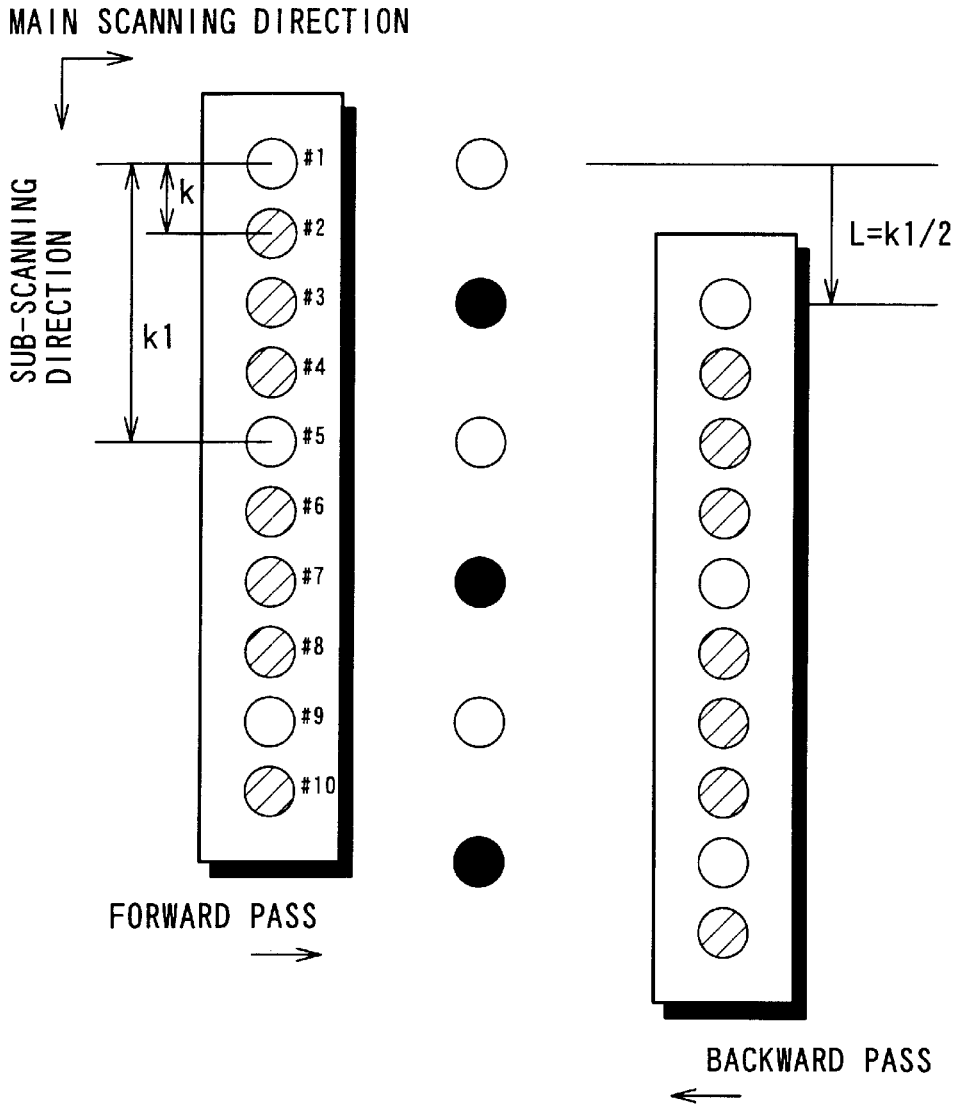
FIG. 13 shows a process of printing a test pattern in the second embodiment.

FIG. 13 shows a process of printing a test pattern in the second embodiment. The print head used in this example has ten nozzles. The printed result of the test pattern shown in FIG. 13 corresponds to only one dot creation timing. For convenience of explanation, nozzle numbers #1 through #10 are allocated to the respective nozzles. The printing system of the second embodiment has the hardware configuration and the functional blocks similar to those of the first embodiment (see FIGS. 3 through 8), except the nozzle pitch k set equal to 360 dpi in the second embodiment.

The technique of the second embodiment does not use all the nozzles on the print head, but prints the test pattern with only part of the nozzles. The nozzles not used for printing are hatched with slant lines. In the example of FIG. 13, only three nozzles #1, #5, and #9 are selected as working nozzles and used for printing. The condition of the selection is that the working nozzles are not adjacent to one another. Although the working nozzles are selected at regular intervals in the second embodiment, the working nozzles may alternatively be selected at irregular intervals. The test pattern is then printed with the selected nozzles. The printed test pattern is apparently equivalent to a test pattern formed at a sparser nozzle pitch in the sub-scanning direction. In the illustrated example of FIG. 13, selection of the nozzles #1, #5, and #9 gives an apparent nozzle pitch k1, which is four times the actual nozzle pitch k, and is equivalent to a print head having nozzles arranged at intervals of 90 dpi. Setting half the apparent nozzle pitch k1 to the feeding amount L enables the same test pattern as the first embodiment to be printed.

The test pattern printed with only the selected nozzles is readily actualized by storing test pattern data in a format that specifies a printing result as an image. A resulting image including dots arranged at the intervals shown in FIG. 13 is stored as the test pattern data. Master data representing no creation of dots are set to the non-selected nozzles, for example, the nozzles #2 through #4, in the course of generating the print control data used to print the test pattern. The illustrated test pattern is thus obtained without any specific processing.

A variety of control processes other than that discussed above are applicable to form the test pattern of the second embodiment. One possible modification stores a test pattern including dots created with all the nozzles, and modifies data not to create dots with unselected nozzles in the process of generating the print control data or masks the unselected nozzles in the printer PRT.

The printing system of the second embodiment prints the test pattern at a sparser nozzle pitch than the resolution in the sub-scanning direction as shown in FIG. 13. The arrangement of the second embodiment enables the dot positions to be readily and accurately adjusted based on the printed test pattern even in a printer with a print head having nozzles arranged at a high density. Strictly speaking, no adjustment of the dot positions is performed for the unselected nozzles. The nozzle row extending in the sub-scanning direction is generally constructed to be driven at an identical timing. Namely adjustment of the dot creation timing with regard to part of the nozzles is sufficient.

Figure 14:
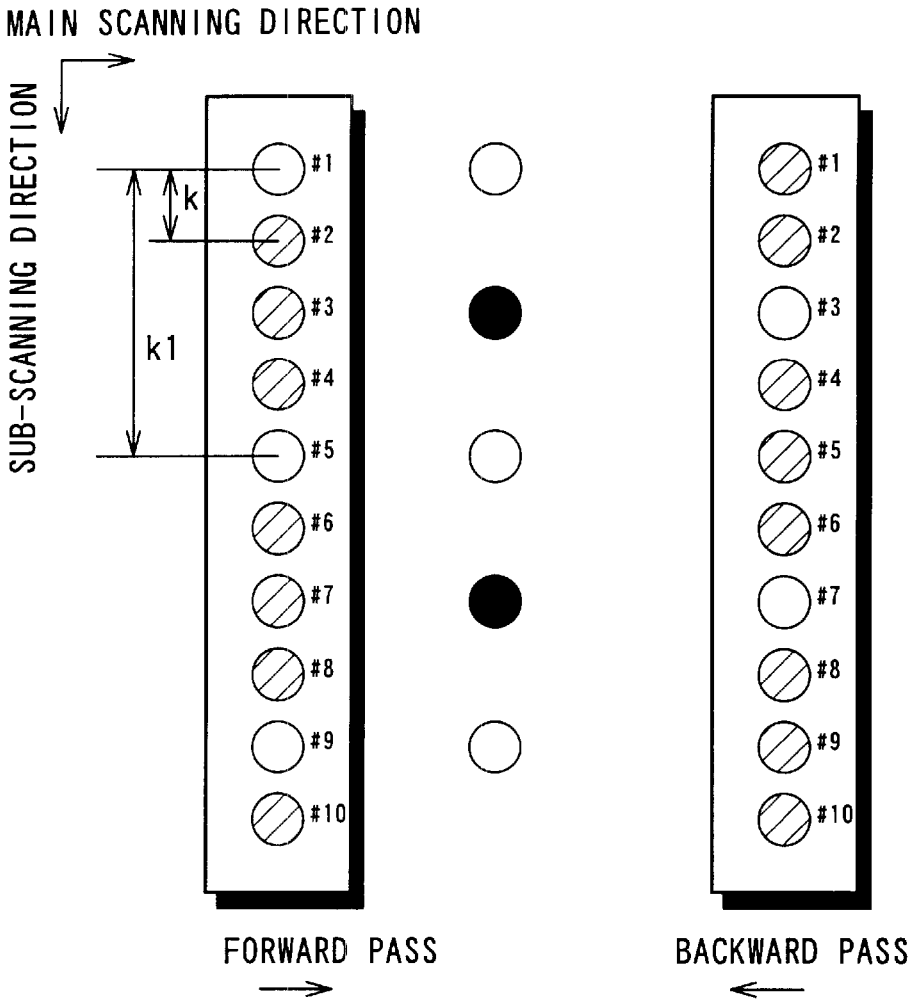
FIG. 14 shows a process of forming a test pattern in one modification of the second embodiment.

In the second embodiment, the test pattern is printed with the sub-scan by the feeding amount that is half the apparent nozzle pitch k1. One possible modification prints a similar test pattern by using different nozzles in the forward pass and in the backward pass. FIG. 14 shows a process of forming a test pattern in one modification of the second embodiment. In this modified example, immediately after the creation of dots in the forward pass, dots are created in the backward pass without any sub-scan. Nozzles #1, #5, and #9 are used in the forward pass, whereas nozzles #3 and #7 are used in the backward pass. The test pattern of the second embodiment may be printed in this manner. This arrangement exerts the same effects as those discussed in the second embodiment. The test pattern may be printed by appropriately combining selection of working nozzles and sub-scan.

D. Third Embodiment

The first embodiment and the second embodiment regard the adjustment of the dot creation timing in the case of bi-directional recording. The principle of the present invention is also applicable to the technique of uni-directional recording. The following describes an application in the case of uni-directional recording to adjust the dot positions with regard to different nozzle rows (hereinafter referred to as the adjustment between different nozzle rows).

A printing system of a third embodiment has the hardware configuration similar to those of the first embodiment and the second embodiment. As discussed previously with FIG. 6, the nozzle array of each color provided on the print head of the printer PRT has two nozzle rows arranged in the main scanning direction. In the description below, one nozzle row is referred to as the $0^{th}$ row, and the other nozzle row is referred to as the $1^{st}$ row. The two nozzle rows have different positions in the main scanning direction and thereby create dots at different timings.

Figure 15:
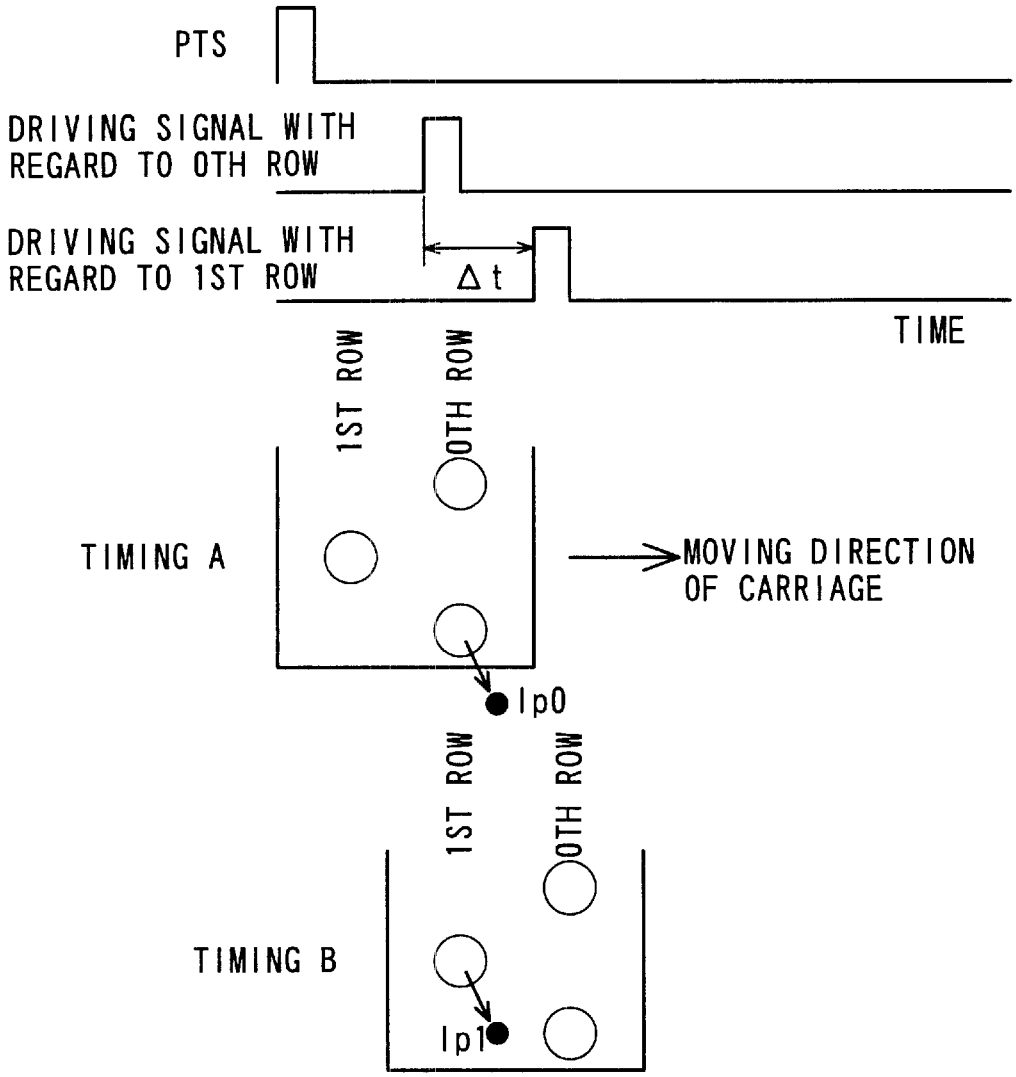
FIG. 15 shows the concept of adjustment between different nozzle rows.

FIG. 15 shows the concept of the adjustment between different nozzle rows. In the example of FIG. 15, the carriage is shifted rightward. The upper portion of the drawing shows the outputs of the PTS signal, the driving signal with regard to the $0^{th}$ row, and the driving signal with regard to the $1^{st}$ row. The lower portion of the drawing shows the positions of the carriage in the main scanning direction at the time points of outputting the drive signal with regard to the $0^{th}$ row and the driving signal with regard to the $1^{st}$ row. When the driving signal with regard to the $0^{th}$ row is output at a predetermined timing after the output of the PTS signal, an ink droplet Ip0 is ejected from each of the nozzles on the $0^{th}$ row at a timing A. The carriage then moves rightward. The driving signal with regard to the $1^{st}$ row is output at the time point when the nozzles on the $1^{st}$ row reach the position that is substantially coincident with the previous position of the nozzles on the $0^{th}$ row at the timing A. An ink droplet Ip1 is then ejected from each of the nozzles on the $1^{st}$ row at a timing B. If a time difference $\Delta t$ between the output of the driving signal with regard to the $0^{th}$ row and the output of the driving signal with regard to the $1^{st}$ row is set to an appropriate value according to the moving speed of the carriage and the ink ejection characteristics of the nozzles on the $0^{th}$ row and the nozzles on the $1^{st}$ row, the dots creating positions by the nozzles on the $1^{st}$ row are deviated from those by the nozzle on the $0^{th}$ row. The adjustment between different nozzle rows compensates for such a deviation.

Figure 16:
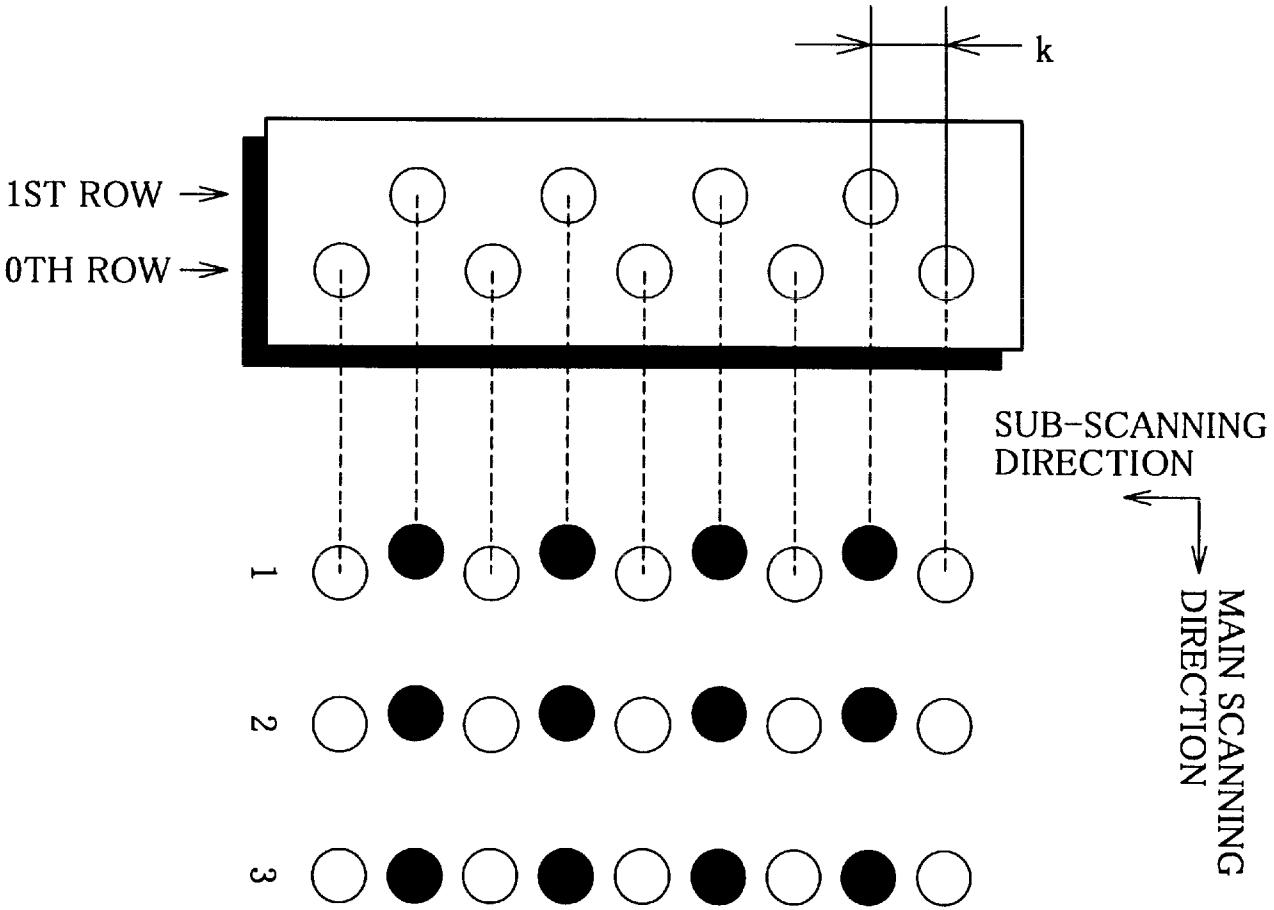
FIG. 16 shows an exemplified test pattern following the technique of a third embodiment.

FIG. 16 shows an exemplified test pattern following the technique of the third embodiment. A print head used in the example of FIG. 16 has five nozzles on the $0^{th}$ row and four nozzles on the $1^{st}$ row. The nozzle pitch k is equal to 90 dpi. The test pattern similar to that of the first embodiment is printed by relatively varying the dot creation timings of the $0^{th}$ row and the $1^{st}$ row while creating dots. The right side of FIG. 16 shows the printed results of the test pattern, where the open circles represent the dots created with the nozzles on the $0^{th}$ row and the closed circles represent the dots created with the nozzles on the $1^{st}$ row. As in the case of the first embodiment, the dots by the nozzles on the $0^{th}$ row and the dots by the nozzles on the $1^{st}$ row are arranged alternately in the sub-scanning direction. While the first embodiment prints the test pattern under the condition of bi-directional recording, the test pattern of the third embodiment is printed by a single pass of the main scan.

As discussed above, the printing system of the third embodiment prints the test pattern with the nozzles on the $0^{th}$ row and with the nozzles on the $1^{st}$ row and adjusts the dot positions according to the same procedure as discussed in the first embodiment. The illustrated example regards the two nozzle rows for an identical color. The adjustment between different nozzle rows is, however, not restricted to the nozzle rows for an identical color. As shown in FIG. 6, the nozzle rows for different colors have different positions in the main scanning direction. These nozzle rows may thus be subjected to the adjustment between different nozzle rows. It is here assumed that the dots shown by the open circles in FIG. 16 are created by the nozzles on the $0^{th}$ row for black, whereas the dots shown by the closed circles are created by the nozzles on the $0^{th}$ row for cyan. In this case, the dot creation timings of these nozzle rows are adjusted according to the same procedure as discussed in the third embodiment. The dot positions of all the nozzle rows are adjusted by successively carrying out the adjustment between different nozzle rows discussed above with regard to the 1row for black, $0^{th}$ row for cyan, $1^{st}$ row for cyan, . . . relative to the $0^{th}$ row for black as the standard.

Figure 17:
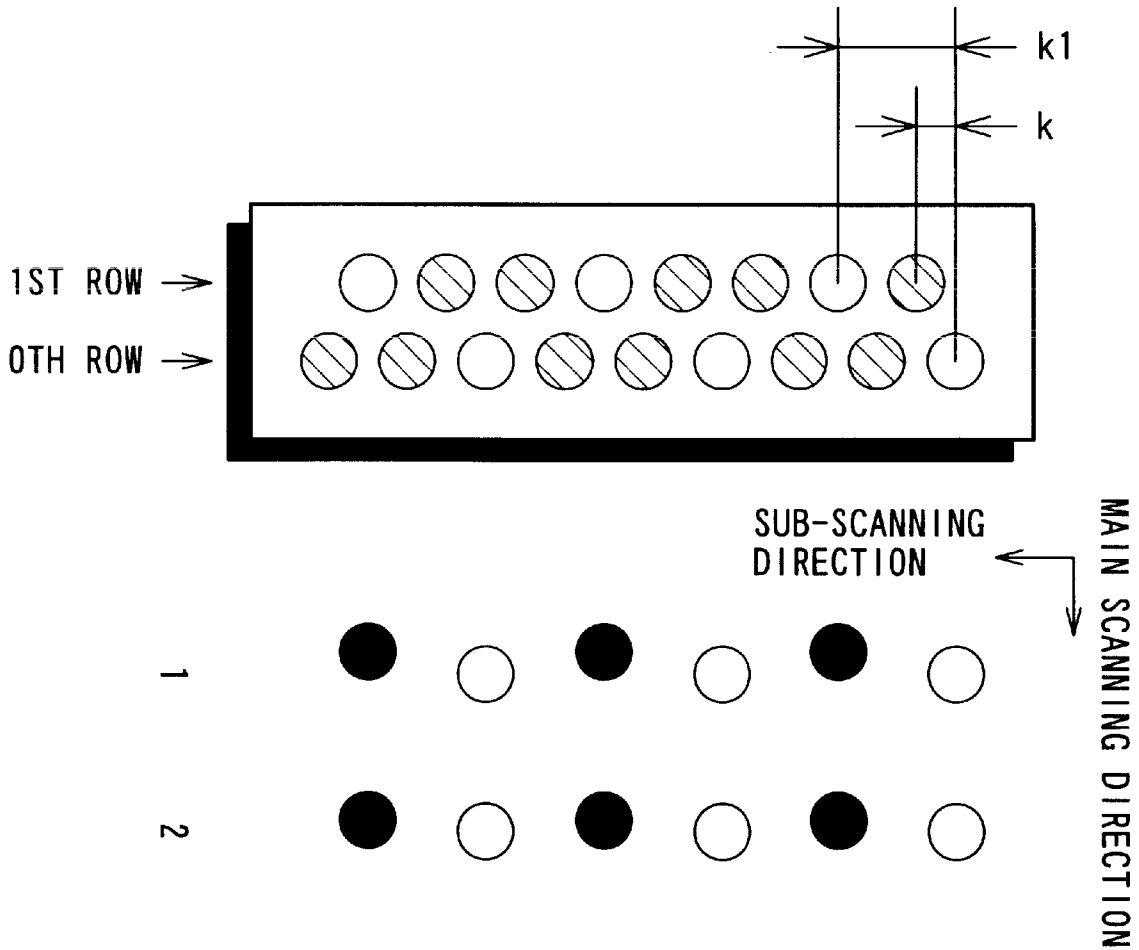
FIG. 17 shows an example of the adjustment between different nozzle rows using only part of the nozzles.

In the case of the adjustment between different nozzle rows, the test pattern may be printed by selectively using part of the nozzles like the second embodiment. FIG. 17 shows an example of the adjustment between different nozzle rows using only part of the nozzles. In the case where the print head has nozzles arranged at an extremely high density, the procedure does not use the hatched nozzles but uses only the selected nozzles to print the test pattern similar to that of the third embodiment. As discussed in the second embodiment, the selection of working nozzles is equivalent to a print head having nozzles arranged at a nozzle pitch k1, which is sparser than the actual nozzle pitch k.

E. First Modification of Third Embodiment

As another example of adjusting the dot positions under the condition of uni-directional recording, the following describes adjustment of the positions of dots having different quantities of ink. In this example, dots of different ink quantities are created by varying the applied voltage in the ejection mechanism utilizing the piezoelectric elements (see FIG. 7). The variation in quantity of ink ejected to form a dot follows the principle discussed below.

Figure 18:
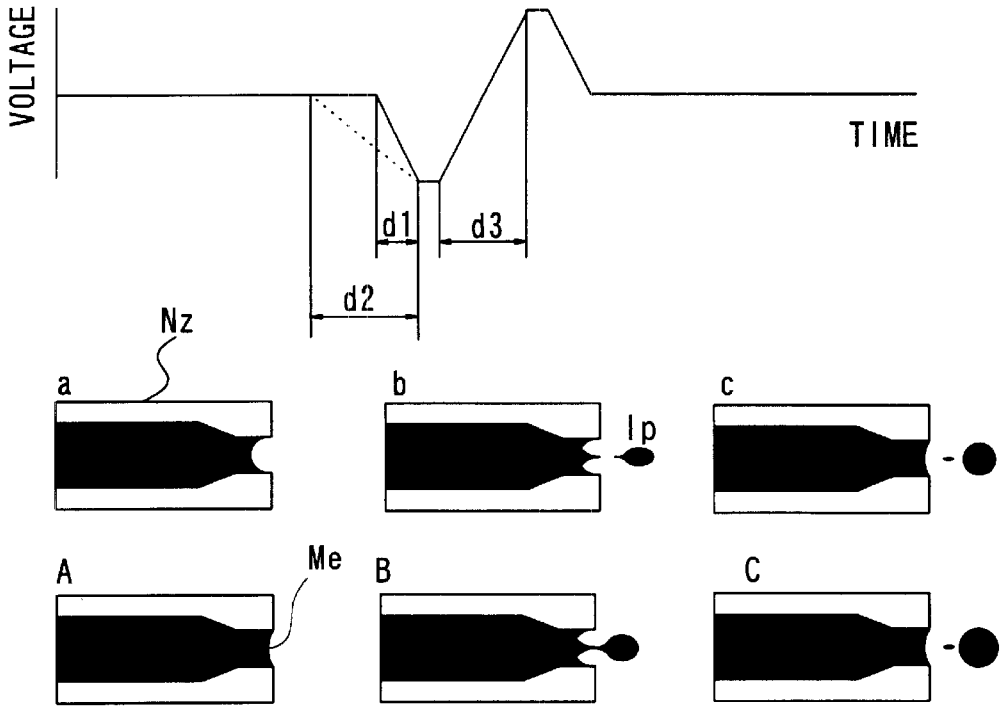
FIG. 18 shows the relationship between the driving waveform and the size of the ink particle Ip ejected from the nozzle Nz.

FIG. 18 shows the relationship between the driving waveform and the size of the ink particle Ip ejected from the nozzle Nz. The driving waveform shown by the broken line in FIG. 18 represents a voltage waveform applied to the piezoelectric element to create standard-size dots. Application of a voltage lower than a reference voltage to the piezoelectric element PE in a division d2 deforms the piezoelectric element PE in the direction of increasing the cross section of the ink conduit 68. Since there is a limit in ink supply speed to the nozzle, the quantity of ink supply has an insufficiency relative to the expansion of the ink conduit 68. As shown in a state A of FIG. 18, an ink interface Me is thus slightly concaved inward the nozzle Nz. When the driving waveform shown by the solid line in FIG. 18 is used to abruptly lower the voltage in a division d1, on the other hand, the quantity of ink supply has a further insufficiency and the ink interface Me is more significantly concaved inward the nozzle Nz as shown in a state 'a', compared with the state A.

Subsequent application of a high voltage to the piezoelectric element PE in a division d3 deforms the piezoelectric element PE in the direction of reducing the volume of the ink conduit 68 to eject ink. As shown in states B and C, a large ink droplet is ejected when the ink interface Me is only slightly concaved inward (state A). As shown in states 'b' and 'c' , on the other hand, a small ink droplet is ejected when the ink interface Me is significantly concaved inward (state 'a'). The size of the dot to be created is varied by changing the rate of decrease in driving voltage (see the divisions d1 and d2) as discussed above. The jet speed of the ejected ink droplet is varied by regulating the slope and the peak value of the driving waveform in the division d3.

Figure 19:
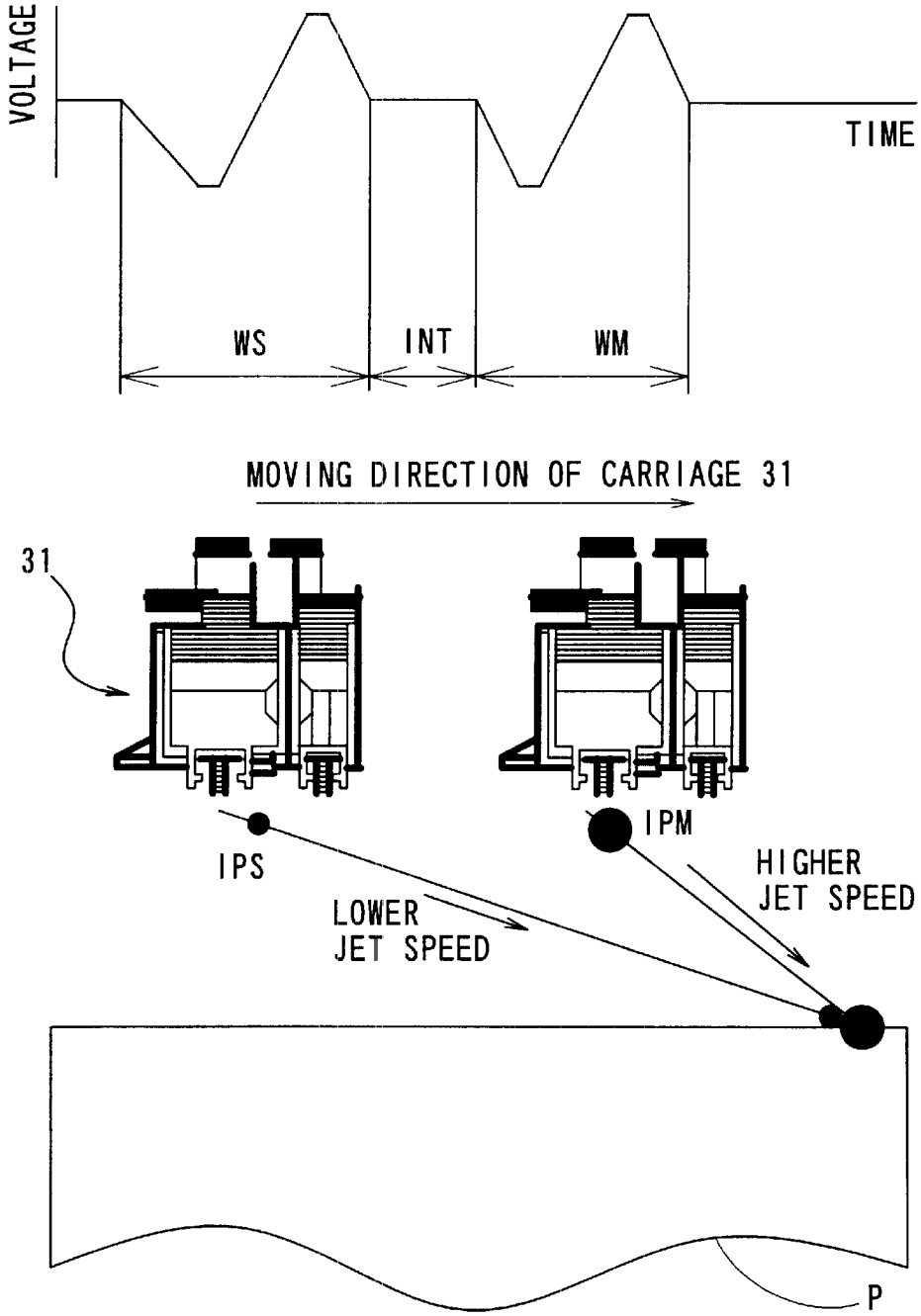
FIG. 19 shows ejection of ink droplets in each pixel in response to different driving waveforms.

The two different driving waveforms for ejecting different quantities of ink are consecutively output with regard to each pixel. This arrangement enables the dot having a desired quantity of ink to be arbitrarily selected and created in each pixel. FIG. 19 shows ejection of ink droplets in each pixel in response to different driving waveforms. The carriage 31 ejects ink droplets while shifting from left to right on the printing paper P. Two different driving waveforms WS and WM are output to the print head in synchronism with the movement of the carriage 31. The driving waveform WS causes a small-sized ink droplet IPS having a smaller quantity of ink to be ejected and form a small dot, whereas the driving waveform WM causes a medium-sized ink droplet IPM having a greater quantity of ink to be ejected and form a medium dot. Ejection of both the small-sized ink droplet IPS and the medium-sized ink droplet IPM in one pixel forms a large dot. In the case where an interval INT between the output of the driving waveform WS and the output of the driving waveform WM is inappropriate, the medium dots may not be aligned with the small dots.

Figure 20:
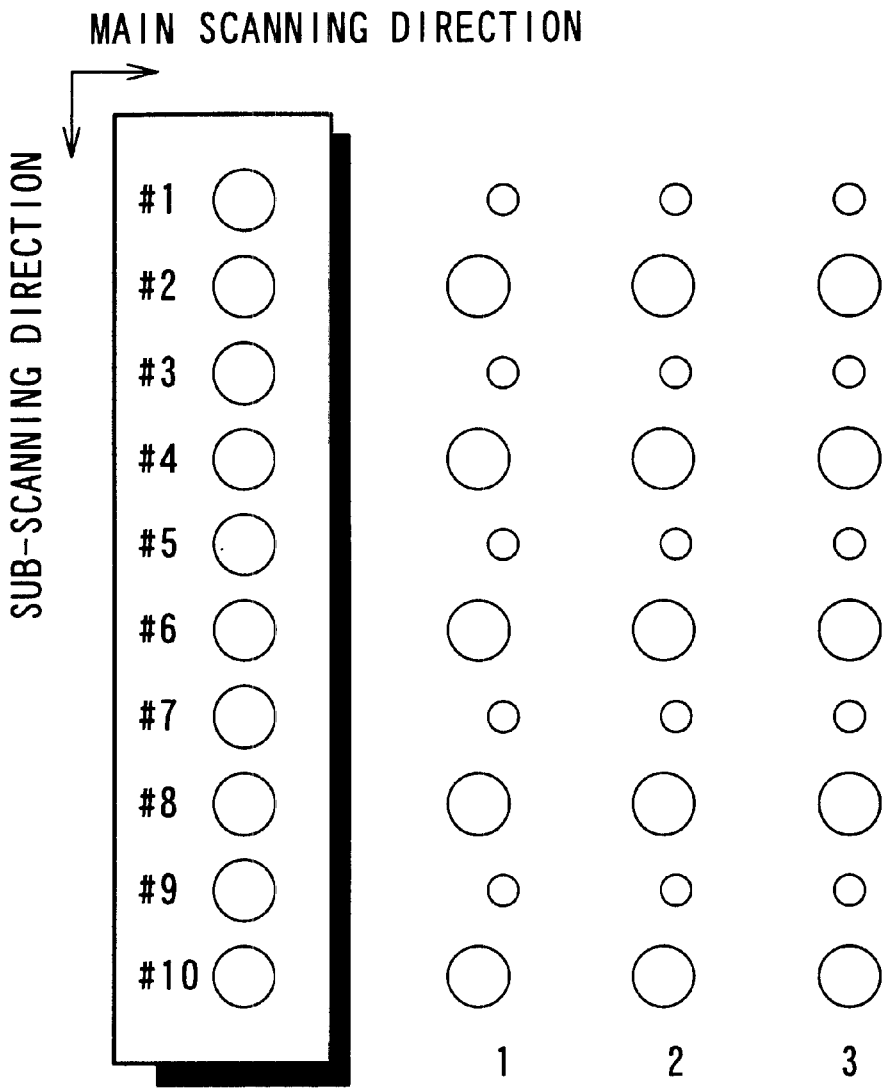
FIG. 20 shows a test pattern used to adjust the dot positions with regard to the small dot and the medium dot in a first modification of the third embodiment.

FIG. 20 shows a test pattern used to adjust the dot positions with regard to the small dot and the medium dot in this modified example. In the example of FIG. 20, a print head having ten nozzles is used to print the test pattern. For convenience of explanation, nozzle numbers #1 through #10 are allocated to the respective nozzles. The nozzles having the odd nozzle numbers (#1, #3, #5, #7, and #9) form small dots, whereas the nozzles having the even nozzle numbers (#2, #4, #6, #8, and #10) form medium dots. A stepwise variation in interval INT between the driving waveform WS and the driving waveform WM causes the printed test pattern to include the small dots and the medium dots arranged alternately in the sub-scanning direction. The dot positions of the small dots and the medium dots are adjusted by specifying the optimum interval INT based on the printed results of the test pattern. In the case where the nozzles are arranged at a high density, the working nozzles are appropriately selected in the same manner as discussed in the second embodiment, in order to ensure the accurate detection of a misalignment. Although the first modification regards the application in the structure of creating dots having different quantities of ink, the dots having an identical quantity of ink may be formed in response to the driving waveforms WS and WM.

F. Second Modification of Third Embodiment

The adjustment of positions of dots having different quantities of ink is not restricted to the structure that consecutively outputs the. driving waveforms as discussed in the first modification. As a second modification, the following describes adjustment of the dot creation timing in the structure that is capable of selectively outputting either one of two driving waveforms for ejecting different quantities of ink with regard to each pixel. The configuration of selectively outputting one of the driving waveforms WS and WM described in the first modification may be applied for the technique of the second modification. The adopted mechanism in this second modified example, however, ejects ink by means of bubbles produced under the application of heat to the ink.

Figure 21:
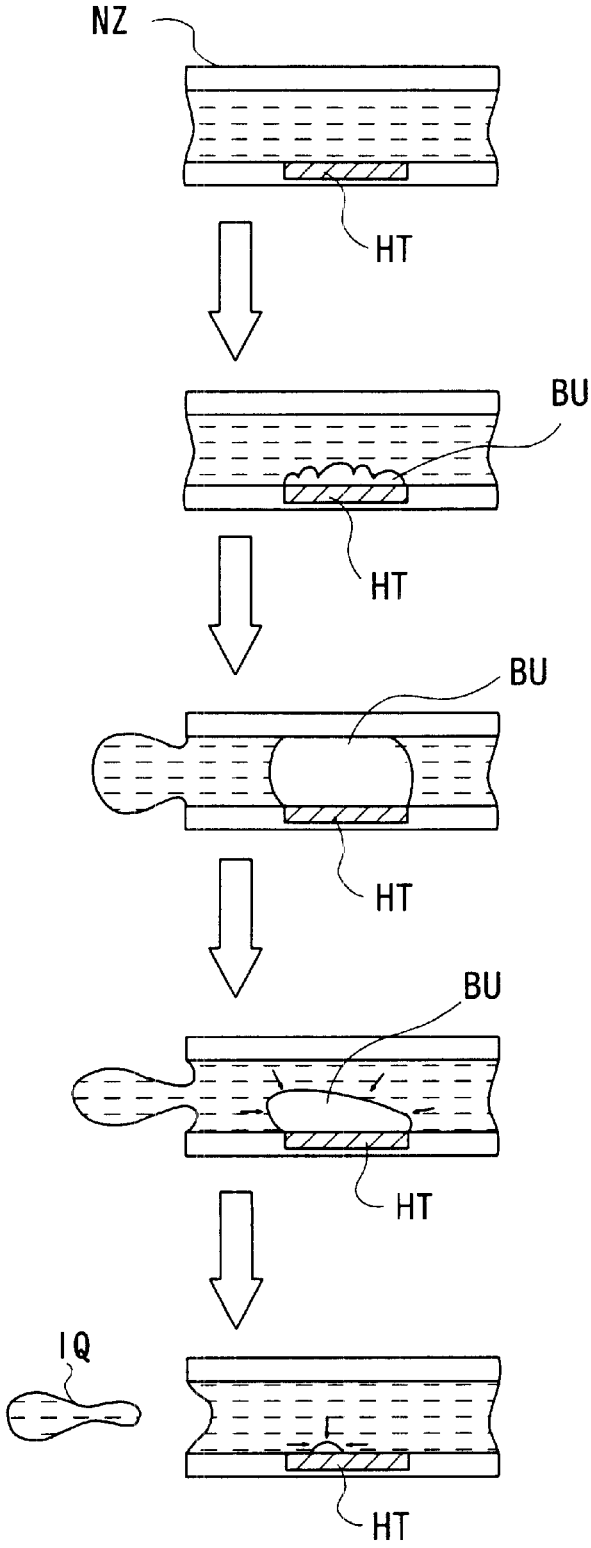
FIG. 21 shows the principle of ink ejection by taking advantage of bubbles.

FIG. 21 shows the principle of ink ejection by taking advantage of bubbles. A heater HT is disposed in the ink conduit of the nozzle Nz. Power supply to the heater HT causes air bubbles BU in the ink, and an ink droplet IQ is ejected by the pressure of the air bubbles BU. In one practical application, two heaters are installed in each nozzle NZ. A small dot is created in response to the power supply to one heater, and a large dot is created in response to the power supply to both the heaters.

Figure 22:
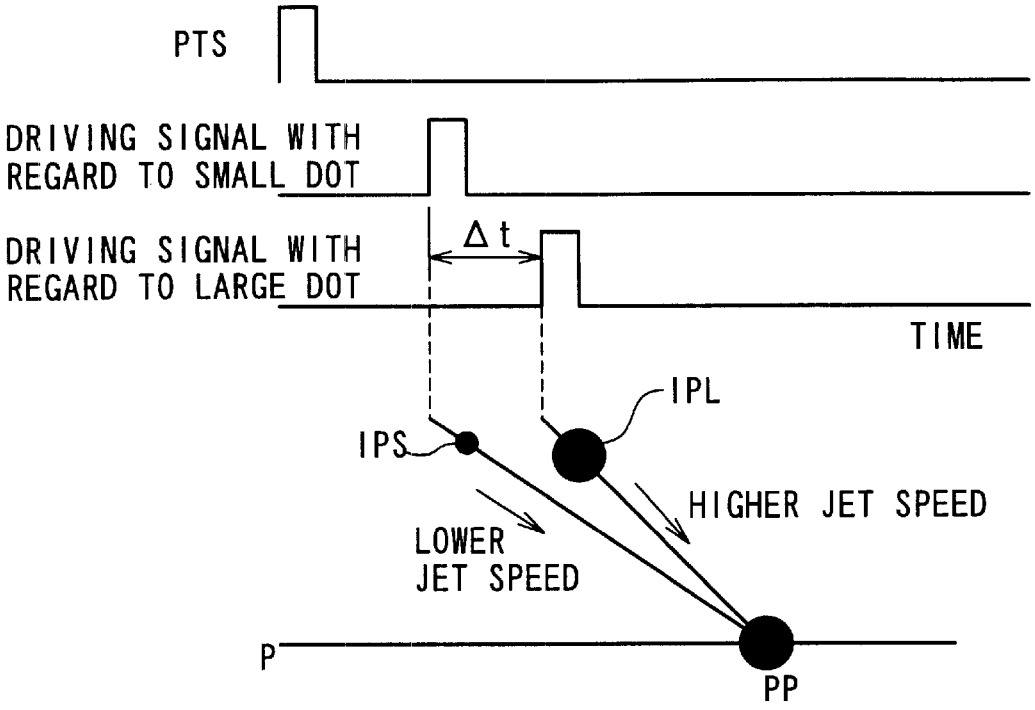
FIG. 22 shows adjustment of the dot creation timing in a second modification of the third embodiment.

When there is a difference in jet speed between the small dot and the large dot, it is required to adjust the dot creation timing with regard to the small dot and the large dot. FIG. 22 shows adjustment of the dot creation timing in the second modification. A driving signal for the small dot is output at a predetermined timing after the output of the PTS signal. An ink droplet IPS ejected in response to this driving signal flies along an illustrated locus and hits a pixel of interest PP on the printing paper P. A driving signal for the large dot is output at another predetermined timing after the output of the PTS signal, in order to create a large dot. In the case where the jet speed of the small dot is coincident with the jet speed of the large dot, both the dots are created in the identical pixel PP by setting the output of these driving signals at an identical timing. In the case where the large dot has a higher jet speed than the small dot, in order to create both the dots in the identical pixel PP, it is required to output the driving signal for the large dot at a timing later than the output timing of the driving signal for the small dot as shown in FIG. 22. In the case where the large dot has a lower jet speed than the small dot, on the contrary, it is required to output the driving signal for the large dot at an earlier timing. In this manner, the time difference $\Delta t$ between the output timings of the respective driving signals should be regulated according to the difference between the jet speed of the small dot and the jet speed of the large dot.

Application of the test pattern discussed in the first modification (see FIG. 20) under such conditions enables the accurate adjustment of the dot positions with regard to the small dot and the large dot. In this case, the nozzles having the odd nozzle numbers (#1, #3, #5, #7, and #9) form the small dots, whereas the nozzles having the even nozzle numbers (#2, #4, #6, #8, and #10) form the large dots. A stepwise variation in dot creation timing with regard to the large dot gives the printed results of the test pattern as shown in FIG. 20. The dot creation timing is adjusted, based on the printed results of this test pattern.

The first through the third embodiments and the modified examples discussed above regard the adjustment of the dot positions with regard to two different dots. The principle of the present invention is applicable to the arrangement of combining these procedures and adjusting the dot positions with regard to a plurality of different dots. One possible application carries out the adjustment between different nozzle rows in combination with the adjustment between the forward pass and the backward pass of the main scan. The dot positions with regard to the plurality of different dots are successively adjusted by repeatedly printing the test pattern while varying the combination of dots. The technique of the present invention is applicable to the adjustment of dot positions with regard to a plurality of different dots created at different ink ejection timings, for example, dots created in the forward pass and in the backward pass of the main scan, dots created by nozzle rows having different positions in the main scanning direction, and dots created at different output timings of the driving waveforms relative to the output of the PTS signal.

Figure 23:
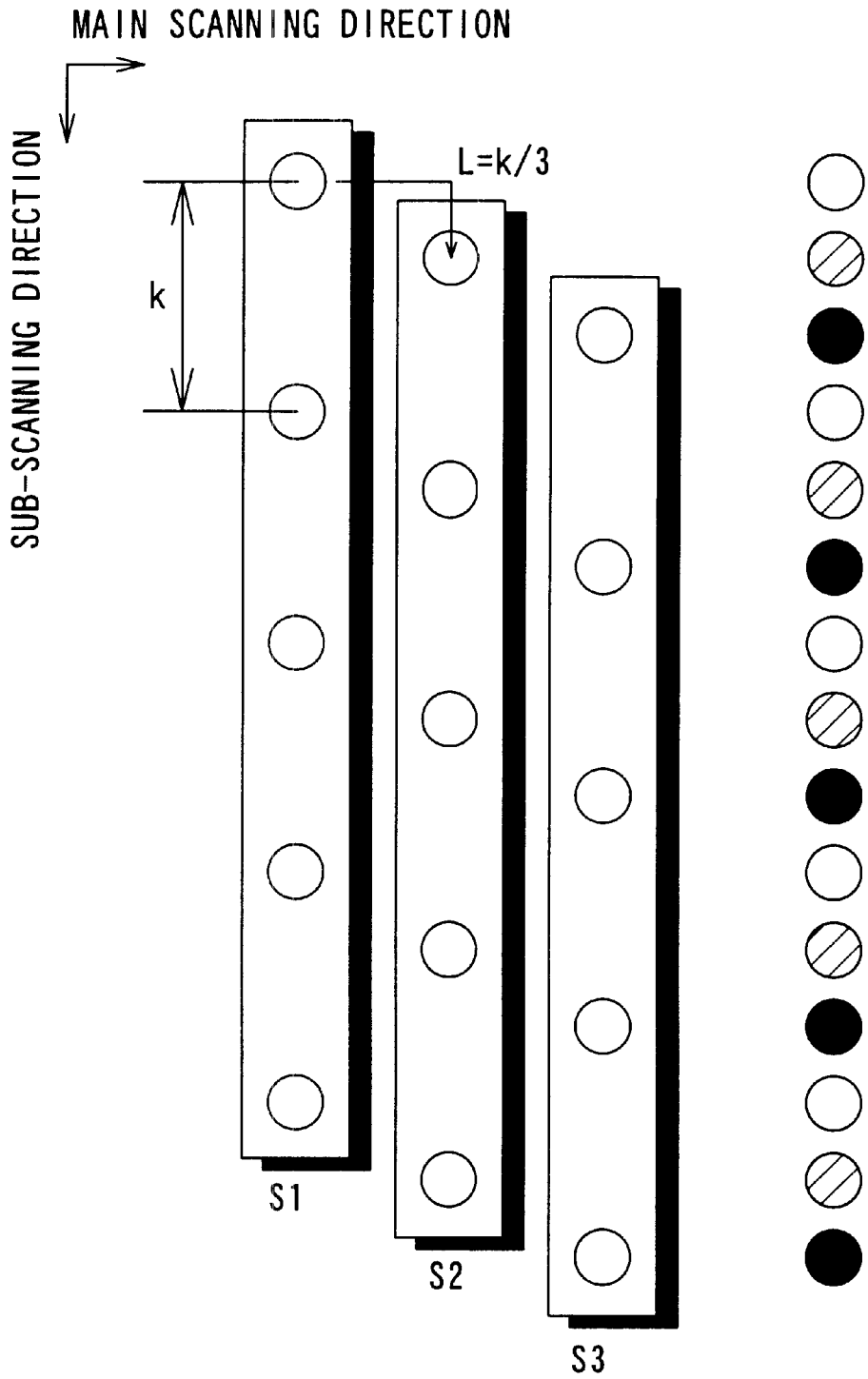
FIG. 23 shows a process of printing a test pattern including three different dots.
Figure 24:
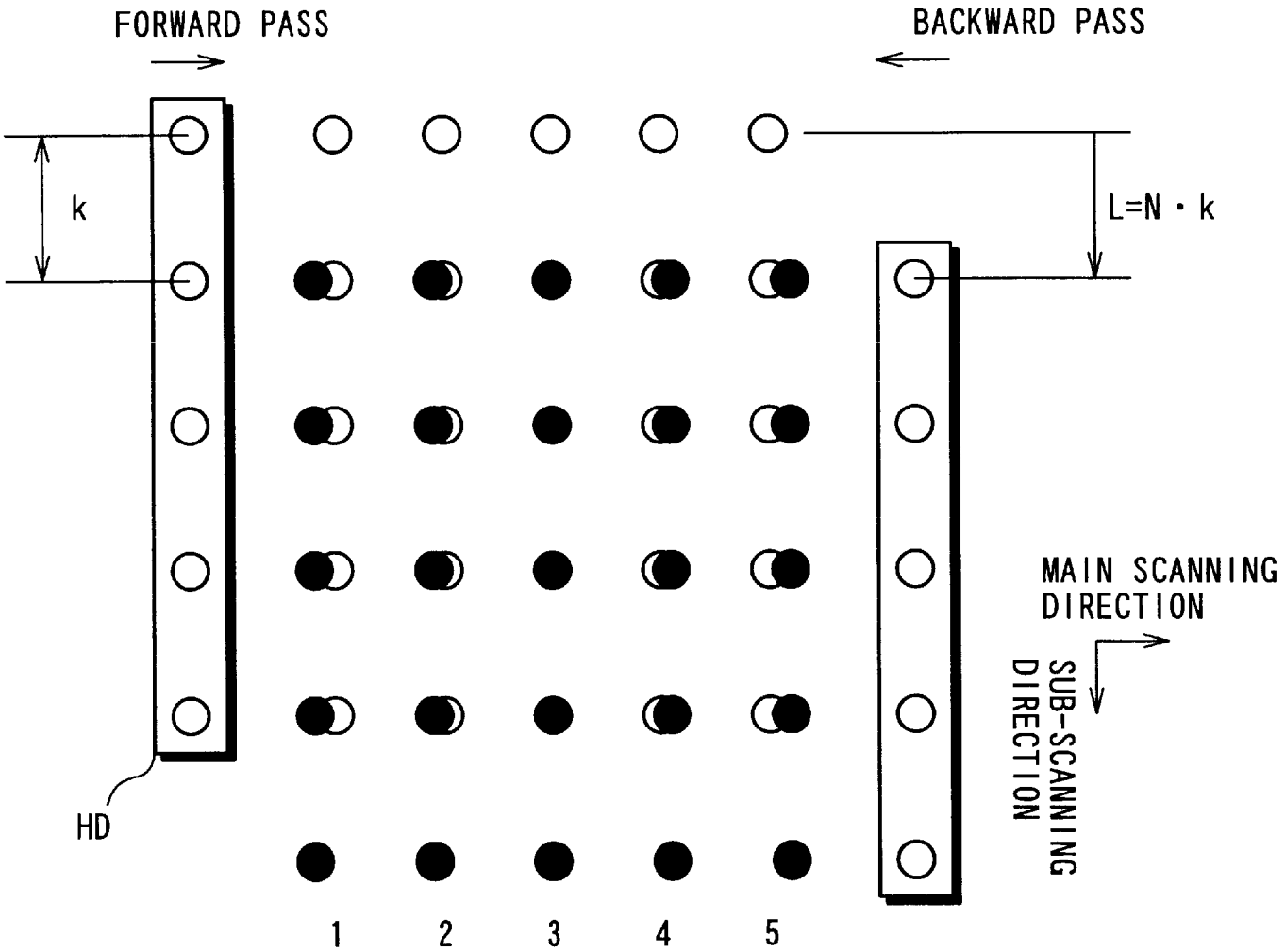
FIG. 24 shows a prior art test pattern.
Figure 25:
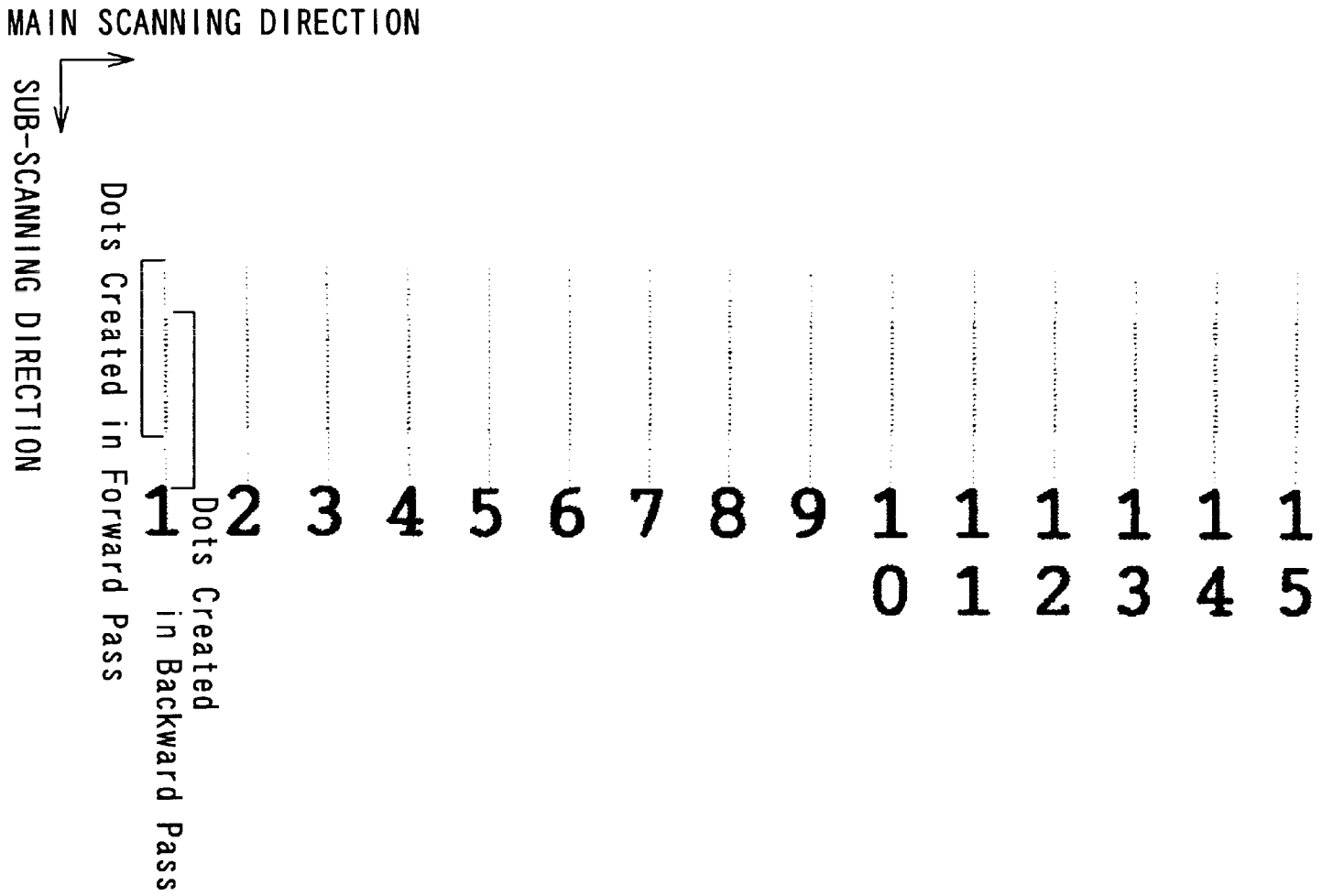
FIG. 25 is an enlarged view showing a test pattern actually printed.

The test pattern of the present invention is not restricted to the application of adjusting the dot creation timing with regard to two different dots as the plurality of different dots mentioned above. FIG. 23 shows a process of printing a test pattern including three different dots. In the example of FIG. 23, each print head has five nozzles. The three different dots are created by print heads of three different colors respectively at positions S1, S2, and S3 in the sub-scanning direction. This gives a test pattern including the three different dots arranged alternately. In this case, the feeding amount L is set equal to one third of the nozzle pitch k, that is, k/3. In one application of this test pattern, two different dots having the adjusted dot positions are formed by the print heads at the positions S1 and S2, and the dot, which is the current target of the adjustment process, is created by the print head at the position S3. This arrangement enables adjustment of the dot creating position with regard to the current target dot, while confirming no misalignment between the previously adjusted dots. Although FIG. 23 shows the application with regard to three different dots, the same technique is applicable to other applications with regard to four or more different dots.

The embodiments and the modified examples discussed above regard the application in which dots created at different timings are arranged alternately. The test pattern of the present invention is, however, not restricted to this application. For example, the test pattern of FIG. 20 may be modified to another arrangement, in which a plurality of small dots are interposed between each pair of medium dots. In this case, the nozzles #1, #4, #7, and #10 are used to create the medium dots, whereas the other nozzles are used to create the small dots. The test pattern having a difference between the numbers of the respective dots is preferable in the case of adjusting the dot creation timing with regard to dots having different visual recognizabilities, for example, in the case of the adjustment between dots having different quantities of ink. This arrangement makes the visual recognizabilities of these dots closer to each other and ensures the accurate adjustment of the dot creation timing.

The present invention is not restricted to the above embodiments or their modifications, but there may be many other modifications, changes, and alterations without departing from the scope or spirit of the main characteristics of the present invention. For example, the series of control processes described in the embodiments may partly or wholly be attained by a hardware configuration. Some of the functions performed by the computer PC in the above embodiments may be carried out by the printer PRT.

The scope and spirit of the present invention are limited only by the terms of the appended claims.

What is claimed is:

1. A print control apparatus that generates print control data for causing a printer unit to print a test pattern based on the print control data, said printer unit carrying out main scan and sub-scan and creating dots at different positions in a sub-scanning direction with a plurality of dot-forming elements, said test pattern being used to detect a misalignment of a plurality of dots created by driving said dot-forming elements at different times, wherein said test pattern satisfies:

a condition that the plurality of dots are created in a plurality of pixels having an identical position in a main scanning direction but different positions in the sub-scanning direction; and a condition that dots created at one time are respectively linearly interposed in the sub-scanning direction between dots created at another previous time in at least part of said test pattern.

2. A print control apparatus in accordance with claim 1, wherein said printer unit is capable of creating dots in both a forward pass and a backward pass of the main scan, and said test pattern is printed to detect a misalignment of dots created in the forward pass with dots created in the backward pass.

3. A print control apparatus in accordance with claim 1, wherein in said printer unit said plurality of dot-forming elements are arranged in the sub-scanning direction and in the main scanning direction in a two-dimensional manner, and said test pattern is printed to detect a misalignment of dots created by dot-forming elements having different positions in the main scanning direction.

4. A print control apparatus in accordance with claim 1, wherein each of said plurality of dot-forming elements has a mechanism that is capable of ejecting an ink droplet at a varying jet speed to create a dot of a varying ink quantity, and said test pattern is printed to detect a misalignment of dots formed by ink droplets ejected at different jet speeds.

5. A print control apparatus in accordance with claim 1, wherein said test pattern includes dots arranged at such an interval that adjoining dots in the sub-scanning direction are not in contact with each other.

6. A print control apparatus in accordance with claim 5, wherein the print control data causes said printer unit to print said test pattern using part of said plurality of dot-forming elements, which are not adjacent to one another.

7. A printing apparatus that comprises:

a printer unit that carries out main scan and sub-scan and creates dots with a plurality of dot-forming elements having different positions in a sub-scanning direction; and a print control apparatus in accordance with any one of claims 1 through 6.

8. A recording medium in which a specific program is recorded in a computer readable manner, said specific program generating print control data that cause a printer unit to print a test pattern, said printer unit carrying out main scan and sub-scan and creating dots with a plurality of dot-forming elements that have different positions in a sub-scanning direction, said test pattern being used to detect a misalignment of a plurality of dots created in each pixel by driving said dot-forming elements at different times, said specific program attaining functions of said print control apparatus in accordance with any one of claims 1 through 10.

9. A print control apparatus that generates print control data for causing a printer unit to print a test pattern based on the print control data, said printer unit carrying out main scan and sub-scan and creating dots at different positions in a sub-scanning direction with a plurality of dot-forming elements, said test pattern being used to detect a misalignment of a plurality of dots created by driving said dot-forming elements at different times, wherein said test pattern satisfies:

a condition that the plurality of dots are created in a plurality of pixels having an identical position in a main scanning direction but different positions in the sub-scanning direction; and a condition that dots created at one time are respectively linearly interposed in the sub-scanning direction between dots created at another time in at least part of said test pattern, wherein said printer unit has said dot-forming elements at a pitch of k raster lines in the sub-scanning direction, where k is a natural number of not less than 2, and the print control data causes said printer unit to carry out the sub-scan by a feeding amount of $s \cdot k/m$ raster lines and print said test pattern, in order to detect a misalignment of dots created at m different times, when m is a natural number of not less than 2, s is equal to 1 or a natural number prime to the natural number m.

10. A print control apparatus that generates print control data for causing a printer unit to print a test pattern based on the print control data, said printer unit carrying out main scan and sub-scan and creating dots at different positions in a sub-scanning direction with a plurality of dot-forming elements, said test pattern being used to detect a misalignment of a plurality of dots created by driving said dot-forming elements at different times, wherein said test pattern satisfies:

a condition that the plurality of dots are created in a plurality of pixels having an identical position in a main scanning direction but different positions in the sub-scanning direction; and said print control apparatus further comprising:

a condition that dots created at one time are respectively linearly interposed in the sub-scanning direction between dots created at another time in at least part of said test pattern, a timing specification unit that causes a user to specify a desired drive timing of said dot-forming elements at each of the different times, based on said printed test pattern; and a modification instructing data generation unit that generates modification instructing data as data supplied to said printer unit to modify a preset drive timing of said dot-forming elements with the specified drive timing.

11. A print apparatus that comprises:

a printer unit that carries out main scan and sub-scan and creates dots with a plurality of dot-forming elements having different position in sub-scanning direction; and a print control apparatus that controls operation of said printer unit, wherein said print control apparatus is a print control apparatus in accordance with claim 8, and said printer unit further comprises a drive timing modification unit that modifies the preset drive timing of said dot-forming elements, based on the modification instructing data generated by said print control apparatus.

12. A method of causing a printer unit to print a test pattern, said printer unit carrying out main scan and sub-scan and creating dots with a plurality of dot-forming elements that have different positions in a sub-scanning direction, said test pattern being used to detect a misalignment of a plurality of dots created in each pixel by driving said dot-forming elements at different times, said method comprising the steps of:

(a) generating print control data to cause said printer unit to print said test pattern that satisfies:

a condition that the plurality of dots are created in a plurality of pixels having an identical position in a main scanning direction but different positions in the sub-scanning direction, and a condition that dots created at one time are respectively linearly interposed in the sub-scanning direction between dots created at another previous time in at least part of said test pattern; and (b) driving said printer unit to print said test pattern according to the print control data.

13. In a printer comprising a print head for ejecting ink droplets to form dots on a printing medium while the print head is moving in a main scanning direction, the print head being shifted in a sub-scanning direction between the main scans, a method of printing a test pattern for adjustment of dot misalignment in the main scanning direction, comprising the steps of:

(a) printing a plurality of first dot arrays each extending in the sub-scanning direction and including plural dots separated from each other in the sub-scanning direction; and (b) printing a plurality of second dot arrays each extending in the sub-scanning direction and including plural dots separated from each other in the sub-scanning direction, at identical main scanning positions with and different sub-scanning position from the plurality of first dot arrays such that at least part of the plural dots of each of the second dot arrays are interposed between dots of the corresponding first dot array.

* * * * *